US012157615B2

(12) United States Patent
Zacherle

(10) Patent No.: US 12,157,615 B2
(45) Date of Patent: Dec. 3, 2024

(54) CARTON AND BLANK THEREFOR

(71) Applicant: WESTROCK PACKAGING SYSTEMS, LLC, Atlanta, GA (US)

(72) Inventor: Matthew E. Zacherle, Moseley, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 72 days.

(21) Appl. No.: 17/785,368

(22) PCT Filed: Dec. 16, 2020

(86) PCT No.: PCT/US2020/065224
§ 371 (c)(1),
(2) Date: Jun. 14, 2022

(87) PCT Pub. No.: WO2021/126914
PCT Pub. Date: Jun. 24, 2021

(65) Prior Publication Data

US 2023/0034920 A1 Feb. 2, 2023

Related U.S. Application Data

(60) Provisional application No. 62/948,471, filed on Dec. 16, 2019.

(51) Int. Cl.
*B65D 71/14* (2006.01)
*B65D 71/36* (2006.01)

(52) U.S. Cl.
CPC ..... *B65D 71/14* (2013.01); *B65D 71/36* (2013.01); *B65D 2571/00141* (2013.01);
(Continued)

(58) Field of Classification Search
CPC ..... B65D 71/14; B65D 71/36; B65D 2571/00141; B65D 2571/00185;
(Continued)

(56) References Cited

U.S. PATENT DOCUMENTS 7,427,010 B2 9/2008 Sutherland
7,913,844 B2 3/2011 Spivey, Sr.
(Continued)

FOREIGN PATENT DOCUMENTS

JP 3030134 U 10/1996
JP 2004149183 A 5/2004
(Continued)

OTHER PUBLICATIONS

Email correspondence from the Japanese Associate dated Jul. 29, 2024 and the Japanese Office Action dated Jul. 8, 2024, 11 pages.

*Primary Examiner* — Christopher R Demeree
(74) *Attorney, Agent, or Firm* — Brian J. Goldberg; Rohini K. Garg

(57) ABSTRACT

Aspects of the disclosure relate to a carton for packaging one or more article and a blank for forming the carton. An aspect of the invention provides a corner folding arrangement comprising a first panel (18) having a corner defined by an end edge and a side edge. A second panel (32*b*) is hingedly connected to the end edge of the first panel along a first fold line. A third panel (20) hingedly connected to the side edge of the first panel along a second fold line. A fourth (34*b*) and fifth (36*b*) panel couple the second panel to the third panel. The fourth panel is hingedly connected to the second panel along a third fold line and the fifth panel is hingedly connected to the third panel along a fourth fold line. A severance line (70) extends between the first and fourth fold lines or between the second and third fold lines. In an unfolded blank form the severance line bypasses a notional intersection of the first and second fold lines such that the notional intersection is located on one side of the severance line spaced apart from the fourth and fifth panels.

19 Claims, 15 Drawing Sheets

(52) U.S. Cl.
CPC ..... *B65D 2571/00185* (2013.01); *B65D 2571/00234* (2013.01); *B65D 2571/00277* (2013.01); *B65D 2571/00444* (2013.01); *B65D 2571/00469* (2013.01); *B65D 2571/0066* (2013.01); *B65D 2571/00716* (2013.01); *B65D 2571/00728* (2013.01); *B65D 2571/00759* (2013.01); *B65D 2571/0087* (2013.01)

(58) Field of Classification Search
CPC ..... B65D 2571/00234; B65D 2571/00277; B65D 2571/00444; B65D 2571/00469; B65D 2571/0066; B65D 2571/00716; B65D 2571/00728; B65D 2571/00759; B65D 2571/0087; B65D 5/4266; B65D 2571/00543
USPC ..... 206/427, 434; 229/103.2, 198.2
See application file for complete search history.

(56) References Cited

U.S. PATENT DOCUMENTS

| | | | |
|---|---|---|---|
| 2008/0099544 | A1 | 5/2008 | Skolic |
| 2015/0225155 | A1 | 8/2015 | Ikeda |

FOREIGN PATENT DOCUMENTS

| | | | |
|---|---|---|---|
| JP | 2016124605 | A | 7/2016 |
| WO | 1982004025 | A1 | 11/1982 |
| WO | 1995008486 | A1 | 3/1995 |

CARTON AND BLANK THEREFOR

CROSS REFERENCE TO RELATED APPLICATION

This application claims the benefit of U.S. Provisional Patent Application No. 62/948,471 filed Dec. 16, 2019. The disclosure of which is herein incorporated by reference in its entirety.

TECHNICAL FIELD

The present invention relates to cartons or carriers and to blanks for forming the same. More specifically, but not exclusively, the invention relates to a corner folding structure and a carrier comprising the same.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide an article carrier having improved machine handling characteristics.

The present invention seeks to provide an improvement in the field of cartons, typically formed from paperboard or the like.

SUMMARY

An aspect of the invention provides a corner folding arrangement comprising a first panel, second panel and a third panel. The first panel has a corner defined by an end edge and a side edge. The second panel may be hingedly connected to the end edge of the first panel along a first fold line. The third panel may be hingedly connected to the side edge of the first panel along a second fold line. A fourth panel and a fifth panel hinged thereto may couple the second panel to the third panel. The fourth panel is hingedly connected to the second panel along a third fold line. The fifth panel is hingedly connected to the third panel along a fourth fold line. A severance line extends between the first and fourth fold lines or between the second and third fold lines. In an unfolded blank form the severance line bypasses a notional intersection of the first and second fold lines such that the notional intersection is located on one side of the severance line spaced apart from the fourth and fifth panels.

Another aspect of the invention provides a carton for packaging one or more articles comprising a plurality of panels forming walls of a tubular structure having an interior. The plurality of panels includes a first panel, second panel and a third panel. The first panel has a corner defined by an end edge and a side edge. The second panel may be hingedly connected to the end edge of the first panel along a first fold line. The third panel may be hingedly connected to the side edge of the first panel along a second fold line. A fourth panel and a fifth panel hinged thereto couple the second panel to the third panel. The fourth panel is hingedly connected to the second panel along a third fold line. The fifth panel is hingedly connected to the third panel along a fourth fold line. The fourth and fifth panels may be disposed in the interior of the carton. A severance line extends between the first and fourth fold lines or between the second and third fold lines. In an unfolded blank form the severance line bypasses a notional intersection of the first and second fold lines such that the notional intersection is located on one side of the severance line spaced apart from the fourth and fifth panels.

A further aspect of the invention provides a carton for packaging one or more articles comprising a plurality of panels forming walls of a tubular structure having an interior. The carton comprises:

- a first wall having an end edge and a side edge adjacent the end edge;
- a second wall hingedly connected to the end edge of the first wall along a first fold line; and
- a third wall hingedly connected to the side edge of the first wall along a second fold line.

A severance line extends at least between the first and second fold lines. The severance line is divergently arranged with respect to one of the first or second fold lines so as to define, at least in part, a projection integral with the first wall, said projection extending outwardly from said one of the first or second fold lines.

Optionally, the carton comprises a pair of gusset panels hingedly connected to each other by a fifth fold line, the pair of gusset panels coupling the second wall to the third wall, the pair of gusset panels being disposed in the interior of the carton.

Optionally, the carton comprises a first gusset panel hingedly connected to a side edge of the second wall along a third fold line, a portion of the severance line extends at least between the first and third fold lines said portion of the severance line being divergently arranged with respect to the third fold line so as to define, at least in part, a projection integral with the second wall and extending outwardly from the third fold line.

Optionally, the carton comprises a second gusset panel hingedly connected to an end edge of the third wall along a fourth fold line, a portion of the severance line extends at least between the fourth and second fold lines said portion of the severance line being divergently arranged with respect to the fourth fold line so as to define, at least in part, a projection integral with the third wall and extending outwardly from the fourth fold line.

Yet another aspect of the invention provides a blank for forming a carton, the blank comprising plurality of panels forming walls of a tubular structure defining an interior, the plurality of panels includes a first panel, second panel and a third panel. The first panel has a corner defined by an end edge and a side edge. The second panel may be hingedly connected to the end edge of the first panel along a first fold line. The third panel may be hingedly connected to the side edge of the first panel along a second fold line. A fourth panel and a fifth panel hinged thereto couple the second panel to the third panel. The fourth panel is hingedly connected to the second panel along a third fold line. The fifth panel is hingedly connected to the third panel along a fourth fold line. The fourth and fifth panels may be disposed in the interior of an erected carton. A severance line extends between the first and fourth fold lines or between the second and third fold lines. In an unfolded blank form the severance line bypasses a notional intersection of the first and second fold lines such that the notional intersection is located on one side of the severance line spaced apart from the fourth and fifth panels.

Still yet another aspect of the invention provides a blank for forming a carton. The blank comprises a first panel having a corner defined by an end edge and a side edge. An end flap is hingedly connected to the end edge of the first panel along a first fold line for at least partially closing an end of the carton. A side panel is hingedly connected to the side edge of the first panel along a second fold line. A pair of first and second hinged gusset panels extend between the end flap and the side panel for placement under one of the end flap and the side panel when the carton is erected. The first gusset panel is hingedly connected to the end flap along a third fold line and the second gusset panel is hingedly connected to the side panel along a fourth fold line. A severance line extends between the first and fourth fold lines or between the second and third fold lines. The severance line bypasses a notional intersection of the first and second fold lines such that the notional intersection is located on one side of the severance line spaced apart from the first and second gusset panels.

Still yet a further aspect of the invention provides a blank for forming a carton. The blank comprises a first panel having a corner defined by an end edge and a side edge. An end flap is hingedly connected to the end edge of the first panel along a first fold line for at least partially closing an end of the carton. A side panel is hingedly connected to the side edge of the first panel along a second fold line. A pair of first and second hinged gusset panels extend between the end flap and the side panel for placement under one of the end flap and the side panel when the carton is erected. The first gusset panel is hingedly connected to the end flap along a third fold line and the second gusset panel is hingedly connected to the side panel along a fourth fold line. A severance line extends between the first and fourth fold lines or between the second and third fold lines. The severance line intersects with at least the third or fourth fold line at a first intersection such that the first intersection is disposed at a position closer to the first gusset panel than a notional intersection of the first and second fold lines.

Optionally, the severance line is linear.

Optionally, the severance line is non-linear. Optionally, the severance line is curvilinear. Optionally, the severance line is arcuate. Optionally, the severance line comprises at least two sections arranged divergently with respect to each other. Optionally, the severance line comprises at least two contiguous sections arranged divergently with respect to each other.

Optionally, the end flap comprises one or more additional fold lines. Optionally, the first panel comprises one or more additional fold lines.

Optionally, the severance line extends into the first panel. Optionally, the first panel is a top or base panel.

Optionally, the severance line extends into the side panel. Optionally, the severance line extends into the end flap.

Optionally, the severance line is convex when viewed from the first gusset panel. Optionally, the severance line is concave when viewed from the first gusset panel.

Optionally, the second gusset panel forms an anchoring panel.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
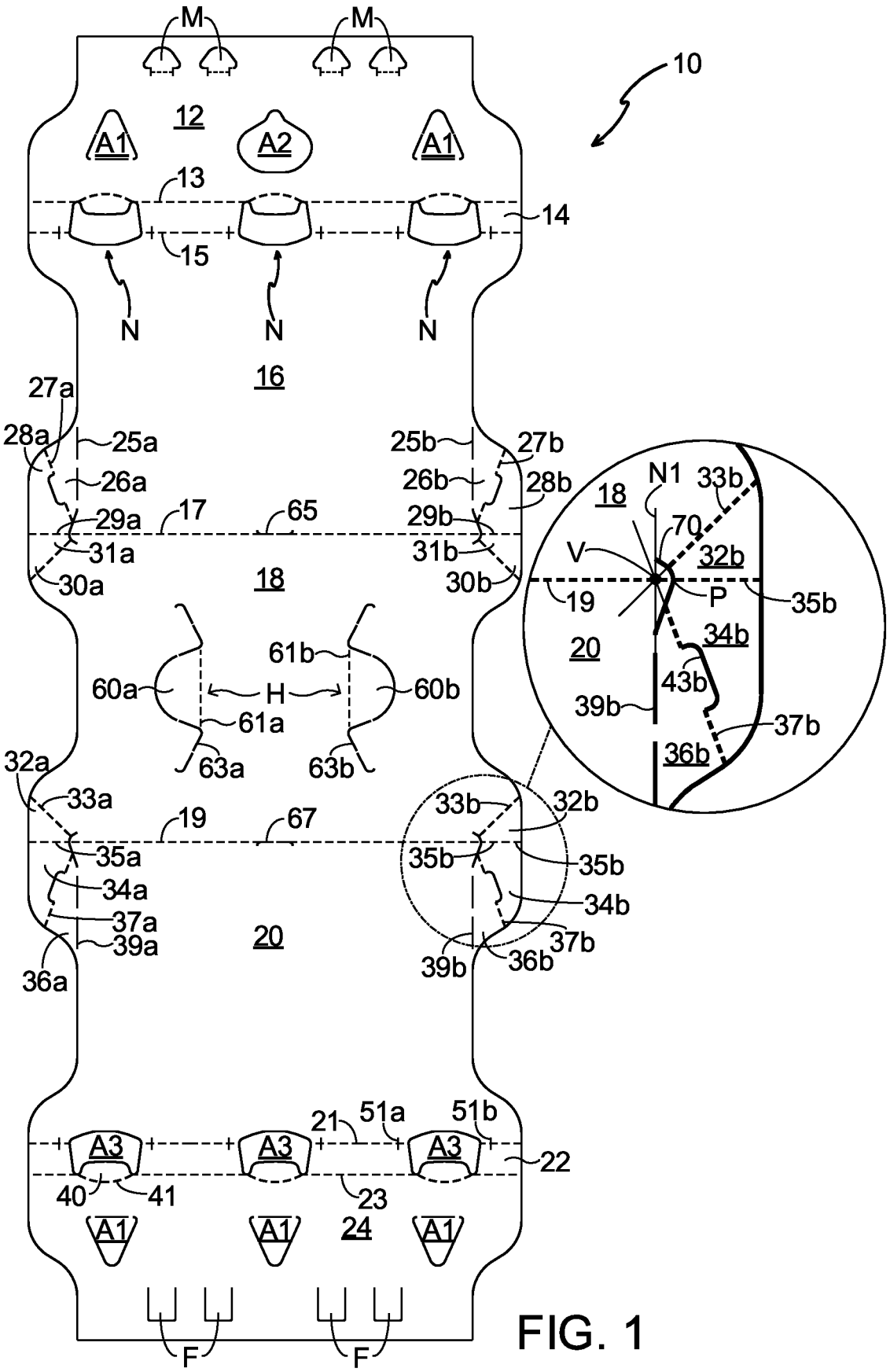
FIG. 1 is a plan view from above of a blank for forming a carton according to a first embodiment.
Figure 2:
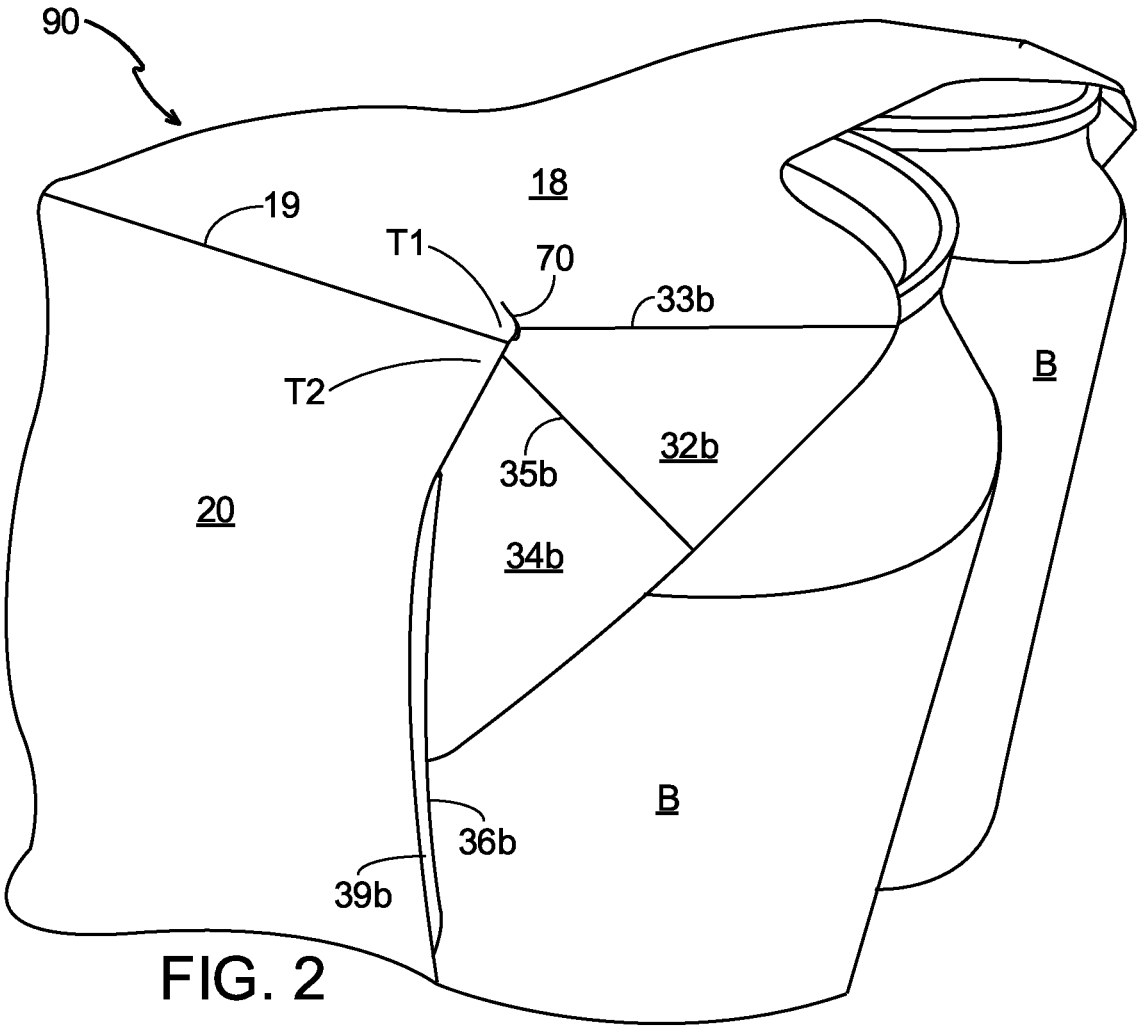
FIG. 2 is a perspective view from above of a portion of a carton formed from the blank of FIG. 1.

Referring to FIG. 1, there is shown a plan view of a blank 10 capable of forming a carton or carrier 90, as shown in FIG. 2, for containing and carrying a group of primary products such as, but not limited to, bottles or cans, hereinafter referred to as articles B, as shown in FIG. 2. The blank 10 forms a secondary package for packaging at least one primary product container or package.

Figure 3:
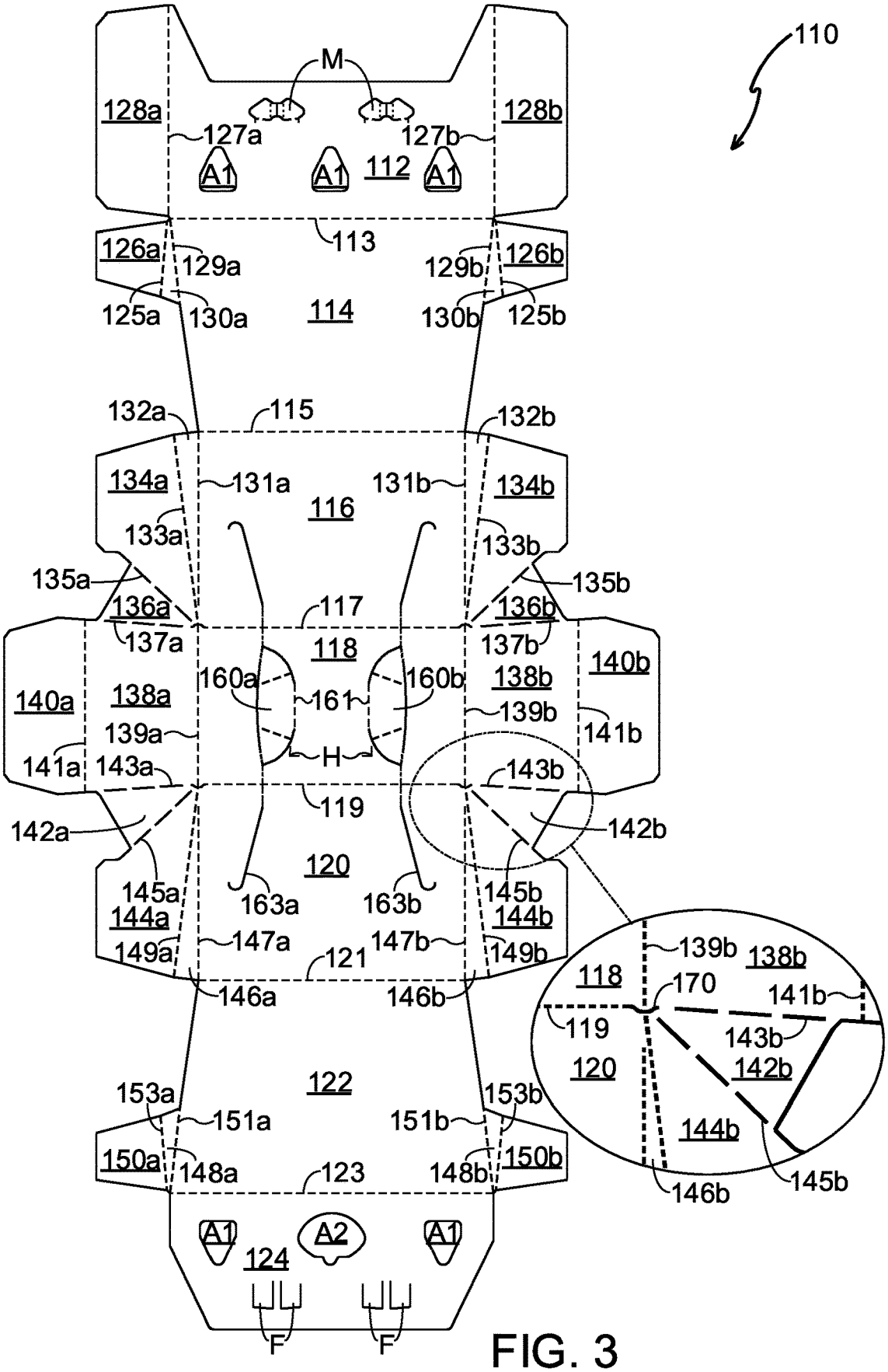
FIG. 3 is a plan view from above of a blank for forming a carton according to a second embodiment.
Figure 4:
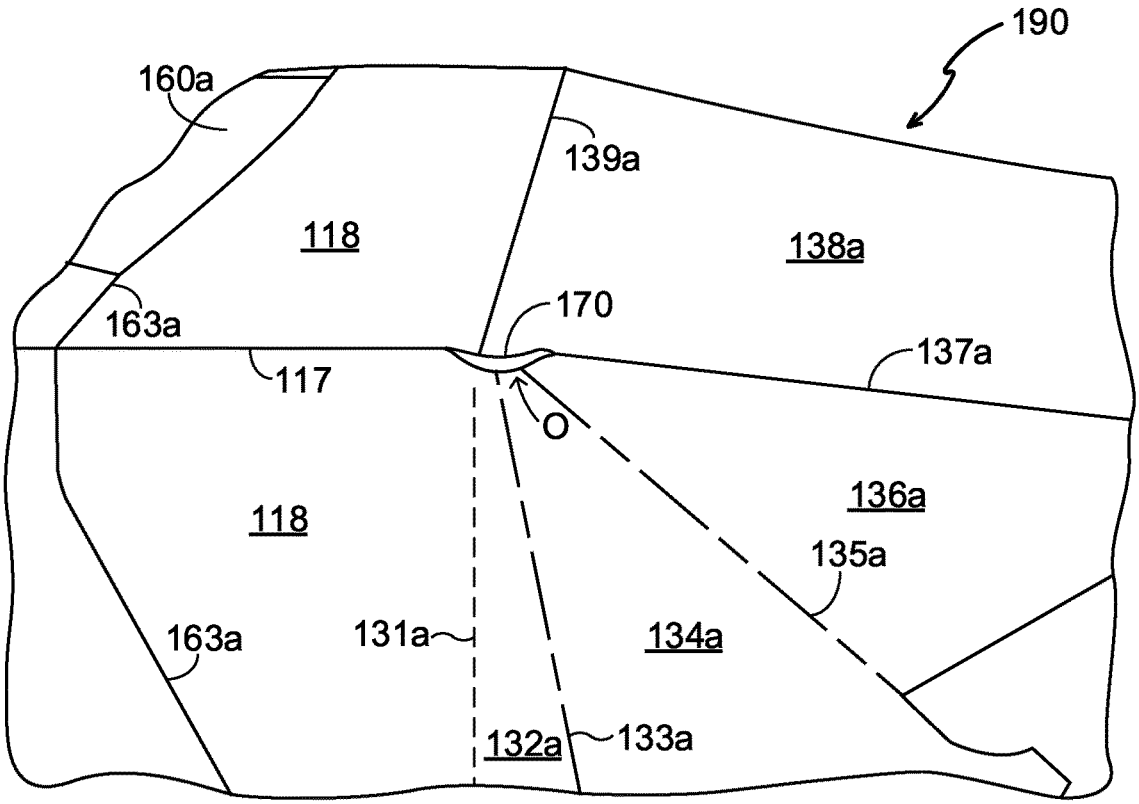
FIG. 4 is a perspective view from above of a portion of a partially assembled carton formed from the blank of FIG. 3.
Figure 5:
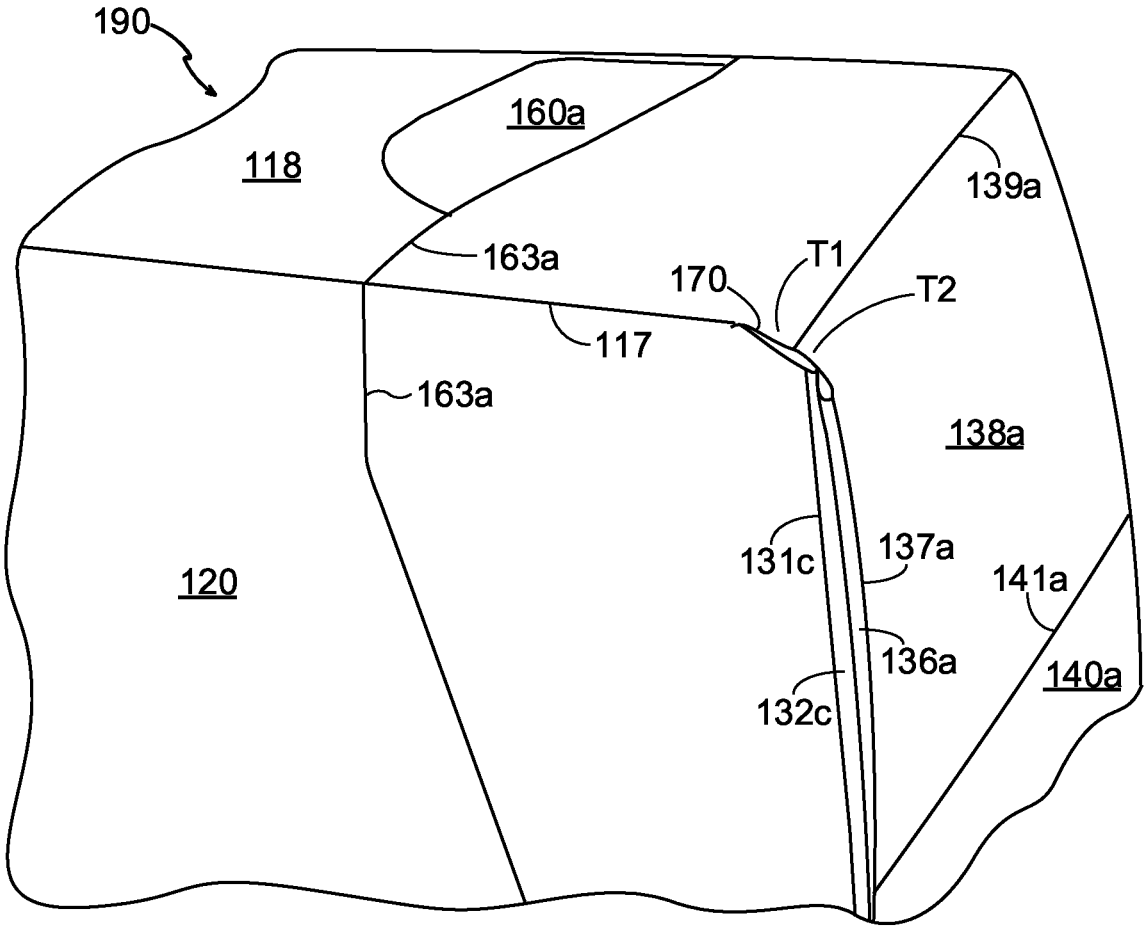
FIG. 5 is a perspective view from above of a portion of a carton formed from the blank of FIG. 3.

Referring to FIG. 3, there is shown a plan view of a blank 110 capable of forming a carton or carrier 190, as shown in FIGS. 4 and 5, for containing and carrying a group of primary products.

Figure 6:
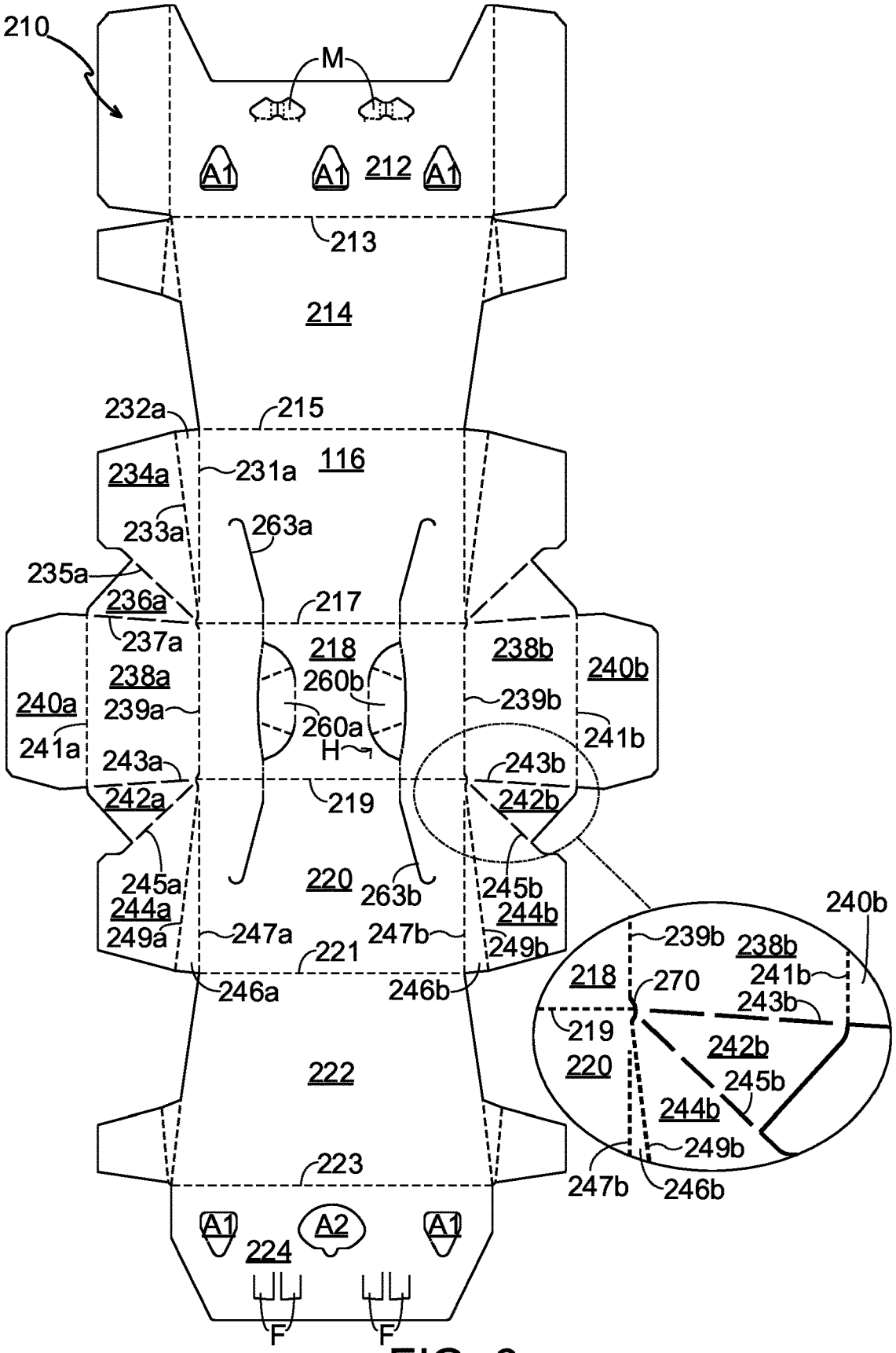
FIG. 6 is a plan view from above of a blank for forming a carton according to a third embodiment.
Figure 7:
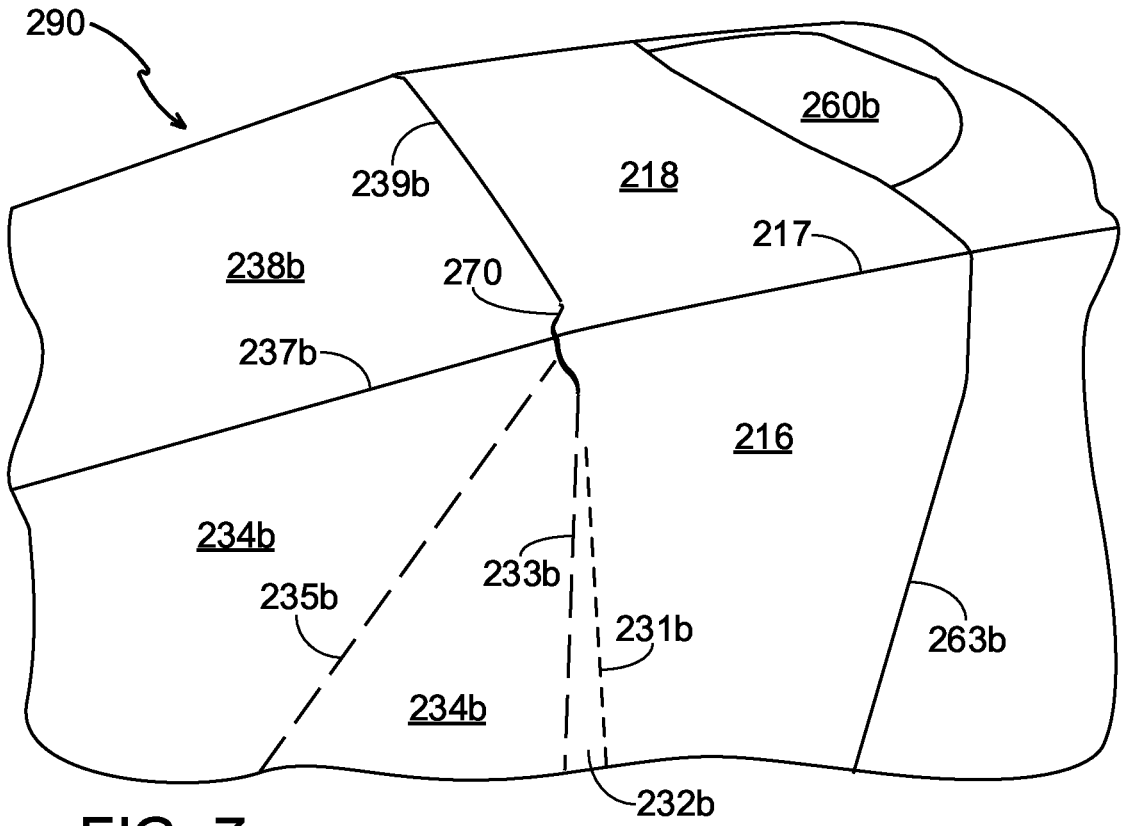
FIG. 7 is a perspective view from above of a portion of a partially assembled carton formed from the blank of FIG. 6.
Figure 6B:
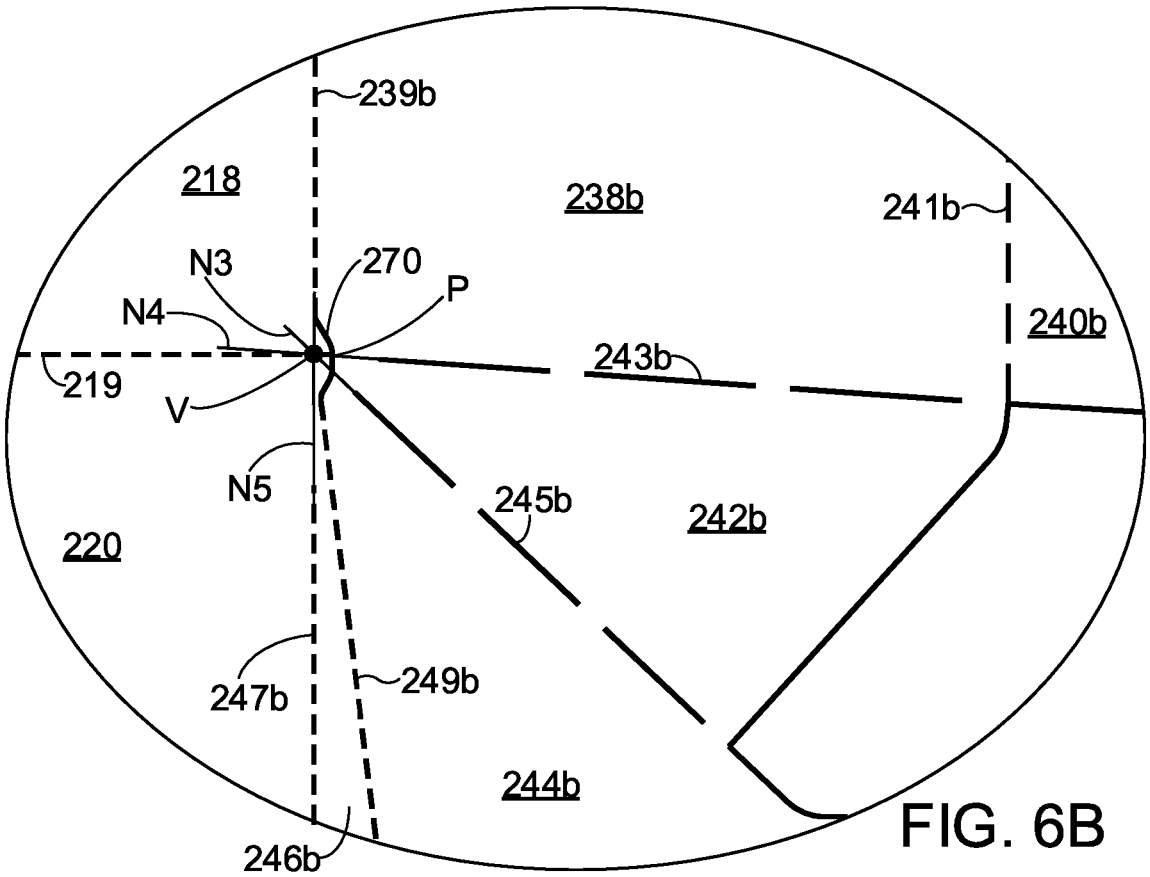
FIG. 6B is an enlarged view of a portion of the blank of FIG. 6.
Figure 8:
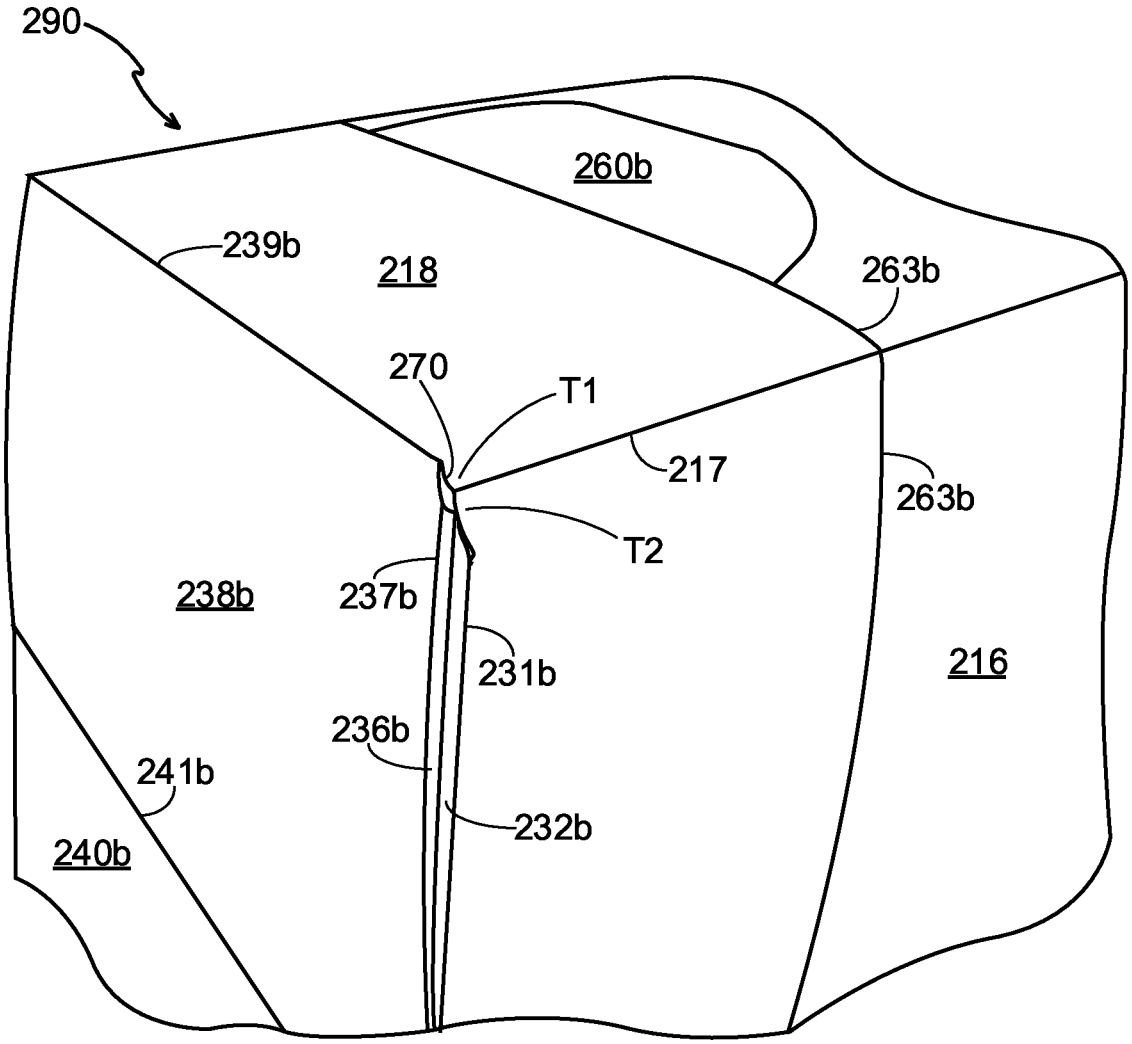
FIG. 8 is a perspective view from above of a portion of a carton formed from the blank of FIG. 6.

Referring to FIG. 6, there is shown a plan view of a blank 210 capable of forming a carton or carrier 290, as shown in FIGS. 7 and 8, for containing and carrying a group of primary products.

Referring to FIGS. 9, 10, 10C, 11, 12 and 17 there are shown plan views of blanks 310; 410; 510; 610; 710; 810 capable of forming a carton or carrier 390; 490; 690, as shown in FIGS. 13A, 13B, 14, 15A and 15B, for containing and carrying a group of primary products.

In the embodiments detailed herein, the terms "carton" and "carrier" refer, for the non-limiting purpose of illustrating the various features of the invention, to a container 90; 190; 290; 390; 490; 690 for engaging and carrying articles B, such as primary product containers B. It is contemplated that the teachings of the invention can be applied to various product containers B, which may or may not be tapered and/or cylindrical. Exemplary containers include bottles B (for example metallic, glass or plastics bottles), cans (for example aluminium cans), tins, pouches, packets and the like.

The blanks 10; 110; 210; 310; 410; 510; 610; 710; 810 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the embodiments illustrated in FIGS. 1, 3, 6, 11 and 12 the blanks 10; 110; 210; 610; 710 are configured to form a carton or carrier 90; 190; 290; 690 for packaging an exemplary arrangement of exemplary articles B. In the embodiments illustrated the arrangement is a 3×2 matrix or array; in the illustrated embodiment two rows of three articles B are provided. In the embodiment of FIG. 1 the articles B are 12 oz (approx. 355 ml) aluminium beverage cans. In the embodiments of FIGS. 3, 6, 11 and 12 the articles B are 12 oz (approx. 355 ml) glass bottles In the embodiment illustrated in FIGS. 9, 10 and 10C, the blanks 310; 410, 510; 810 are configured to form a carton or carrier 390; 490 for packaging an exemplary arrangement of exemplary articles B. In the embodiments illustrated the arrangement is a 2×2 matrix or array; in the illustrated embodiment two rows of two articles B are provided, and the articles B are 16 oz (approx. 473 ml) beverage cans.

Alternatively, the blanks 10; 110; 210; 310; 410; 510; 610; 710; 810 can be configured to form a carrier for packaging other types, number and size of articles B and/or for packaging articles B in a different arrangement or configuration.

The present invention relates generally to a carton 90; 190; 290; 390; 490; 690 for packaging articles B which carton 90; 190; 290; 390; 490; 690 comprises a corner folding structure.

Turning to FIG. 1, there is illustrated a blank 10 for forming a carton 90 (see FIG. 2) according to a first embodiment. The blank 10 comprises a plurality of main panels 12, 14, 16, 18, 20, 22, 24 for forming a tubular structure. The plurality of main panels 12, 14, 16, 18, 20, 22, 24 comprises; a first base panel 12, a first corner panel 14, a first side panel 16, a top panel 18, a second side panel 20, a second corner panel 22 and a second base panel 20. The plurality of panels 12, 14, 16, 18, 20, 22, 24 may be arranged in a linear series hinged one to the next by corresponding fold lines 13, 15, 17, 19, 21, 23.

In alternative embodiments, the first and second corner panels 14, 22 may be omitted, the fold lines 15, 21 may be omitted.

The first and second corner panels 14, 22 may be considered to form lower portions of the respective one of the first or second side panels 16, 20 to which they are hingedly connected.

The blank 10 is foldable to form a package 90 as illustrated in FIG. 2. The first and second base panels 12, 24 are engageable with one another in an overlapping relationship to form a composite base wall 12/24 of the carton 90. The blank 10 may comprise a complementary locking mechanism for securing the second base panel 24 to the first base panel 12. The first base panel 12 may comprise at least one first part M of the complementary locking mechanism. The second base panel 24 may comprise at least one second part F of the complementary locking mechanism. In the illustrated embodiment, the second base panel 24 comprises a plurality of female tabs F defining openings in the first base panel 12. The first base panel 12 comprises a plurality of male tabs M, the openings in the second base panel 24 being configured to receive a respective one of the male tabs M. The female tabs F are arranged to be displaced out of the second base panel 24 to form the opening and to bear against the male tabs M when received therein. In some embodiments the complementary locking mechanism M/F may be omitted, the first and second base panels 12, 24 may be secured to each other by other means such as but not limited to adhesive or staples.

Optionally, the first and second base panels 12, 24 may comprise at least one first aperture A1. In the illustrated embodiment, each of the first and second base panels 12, 24 comprises two first apertures A1. Optionally, the first and second base panels 12, 24 may comprise at least one second aperture A2. In the illustrated embodiment, the first base panel 12 comprises one second aperture A2. The first and second apertures A1, A2 may be employed to facilitate construction of the carton 90. A packaging machine component may engage with the first and second apertures A1, A2 to enable the plurality of panels 12, 14, 16, 18, 20, 22, 24 to be tightened about a group of articles B. The first and second apertures A1, A2 may also be employed to facilitate alignment of the first and second base panels 12, 24 with respect to each other or to align the first part of the complementary locking mechanism with the second part of the complementary locking mechanism. The complementary locking mechanism illustrated and described is entirely optional.

The blank 10 may comprise at least one heel engagement structure for engaging with a heel or lower portion of an article B. The blank 10 illustrated in FIG. 1 comprises six heel engagement structures each is provided for engaging a respective article B. Each of the heel engagement structures is substantially similar in construction and will be described by reference to a heel engagement structure provided in the second side panel 20 and in the second corner panel 22.

The heel engagement structure may comprise an opening. The opening is defined in part by a heel aperture A3 and in part by a heel tab 40. The heel tab 40 is hingedly connected to the second base panel 24 by a fold line 41. The heel tab 40 may be struck, at least in part, from the second corner panel 22, when present, or from the second side panel 20. The heel tab 40 may be struck, at least in part, from the second base panel 24.

The fold line 41 interrupts the fold line 23 hingedly connecting the second base panel 24 to the second corner panel 22. The fold line 41 may be non-linear, in the illustrated embodiment the fold line 41 is curved or arcuate in shape, in other embodiments it may be formed from at least two linear cut lines divergently arranged with respect to each other and contiguous with each other.

The heel tab 40 may comprise a pair of divergently arranged fold lines (not shown) which may define foldable corner portions of the heel tab 40.

The top panel 18 may comprise an optional handle structure H. The handle structure H comprises a pair of foldable finger tabs 60*a*, 60*b*. The finger tabs 60*a*, 60*b* are spaced apart from each other. The finger tabs 60*a*, 60*b* are hingedly connected to the top panel 18 by fold lines 61*a*, 61*b* and are defined in part by a cut line or severance line 63*a*, 63*b*. A first one of the finger tabs 60*a* is hingedly connected to the top panel 18 in opposition to a second one of the finger tabs 60*b*.

Each of the panels 12, 16, 18, 20, 24 is formed with a pair of cut-outs or recesses. The cut-outs are defined in opposed end edges of the blank 10. The cut-outs comprise full, major cut-outs in the first and second side panel 16, 20 and the top panel 18 and partial or minor cut-outs in the first and second base panels 12, 24.

A first cut-out is defined in the top panel 18 around the midway along each of its opposed end edges. A second cut-out is defined in each end edge of the first side panel 16. A third cut-out is defined in each end edge of the second side panel 20.

A partial or minor cut-out is defined in each of the opposed end edges of each of the first and second base panels 12, 24.

As a result, the blank 10 is provided along either longitudinal edge thereof with four tabs or projections each interposed between adjacent ones of the cut-outs.

As illustrated in FIG. 1, a first upper projection is positioned astride the adjacent fold line 17. A second upper projection is positioned astride the adjacent fold line 19.

A first lower projection is positioned astride the adjacent fold lines 13, 15. A second lower projection is positioned astride the adjacent fold lines 21, 23.

Each of the first and second upper projections provided material for forming, or assisting in forming of, an end retention structure for preventing the contents of the carton 90 from dislodging from the carton 90 when said blank 10 is erected into the carton 90. Each of the first and second upper projections is provided with cut and fold lines to form a top-engaging structure when it is folded along the fold lines.

More specifically, each upper projection comprises an anchoring panel 26*a*, 26*b*, 36*a*, 36*b* hingedly connected to the adjacent side panel 16, 20 along a fold line 25*a*, 35*b*, 39*a*, 39*b*. Each upper projection comprises a gusset panel 28*a*, 28*b*, 34*a*, 34*b* hingedly connected to the anchoring panel 26*a*, 26*b*, 36*a*, 36*b* along a fold line 27*a*, 27*b*, 37*a*, 37*b*.

Each upper projection comprises a web panel 30*a*, 30*b*, 32*a*, 32*b* (also referred herein as a top end closure panel) hingedly connected to the gusset panel 28*a*, 28*b*, 34*a*, 34*b* along an extension 29*a*, 29*b*, 35*a*, 35*b* of respective one of the fold lines 17, 19. Each upper projection comprises a covering portion that is integrally formed with the top panel 18. Each web panel 30*a*, 30*b*, 32*a*, 32*b* is hingedly connected to the respective covering portion by a fold line 31*a*, 31*b*, 33*a*, 33*b*.

The blank 10 comprises a corner folding arrangement, in the illustrated embodiment a gusseted corner arrangement is provided which is free of a punched-out opening. An opening or aperture is usually placed in corner gusset panels to facilitate folding of the gusset panels see, for example, US20150225155 to Ikeda. Such openings create pieces of scrap paper board which need to be separated from the blank 10, in high-speed die-cutting and blanking processes the scrap pieces may tend to hang or snag on the blank 10 or they may be scattered around the die cutting station. These rogue scrap pieces may find their way into subsequent packaging machinery where they may interfere with the assembly process causing jams or downtime. They may cause damage to the machinery or packages.

The blank 10 comprises four corner folding arrangements at each corner of the top panel 18, the corner folding arrangements are substantially the same and will be described with regard to an enlarged view of one of the corner arrangements shown in FIG. 1.

The corner folding arrangement comprises a severance line 70 in the form of a cut line. The severance line 70 extends across or intersects the fold line 19 between the top panel 18 and the second side panel 20, this fold line is also referred to herein as second fold line 19.

The severance line 70 extends from the fold line 39*b* between the second side panel 20 and an anchoring panel 36*b*, the fold line 39*b* is also referred to herein as fourth fold line 39*b*.

The severance line 70 extends towards the fold line 33*b* between the top panel 18 and an end flap 32*b*. The severance line 70 may extend to the fold line 33*b* between the top panel 18 and an end flap 32*b*. The severance line 70 extends beyond or past the fold line 33*b* between the top panel 18 and an end flap 32*b* so as to extend into the top panel 18. The fold line 33*b* is also referred to herein as first fold line 33*b*.

The severance line 70 extends across or through the fold line 35*b* between the top end closure panel 32*b* and the gusset panel 34*b*, this fold line is also referred to herein as third fold line 35*b*.

The severance line 70 extends across or through the fold line 37*b* between anchoring panel 36*b* and the gusset panel 34*b*, this fold line is also referred to herein as fifth fold line 37*b*.

The severance line 70 can be considered to intersect or terminate each of the first, second, third, fourth and fifth fold lines 33*b*, 19, 35*b*, 39*b*, 37*b*.

The severance line 70 in the illustrated embodiment is non-linear and may be curvilinear. In other embodiments the severance line 70 may be defined by two or more linear sections divergently arranged with respect to each other. In still other embodiments the severance line 70 may be linear. In embodiments in which the severance line 70 is linear the severance line 70 may be divergently arranged with respect to the first and/or fourth fold lines 33*b*, 39*b*. The severance line 70 may be divergently arranged with respect to second fold line 19 and may be obliquely oriented thereto.

The severance line 70 extends between the first fold line 33*b* and fourth fold line 39*b*.

The severance line 70 bypasses a notional intersection or vertex V between a notional extension of the first fold line 33*b* and the second fold line 19 such that the notional intersection V is located on one side of the severance line 70. The notional intersection V is located on a first side of the severance line 70 and anchor and gusset panels 36*b*, 34*b* are located on a second, opposing, side of the severance line 70. The notional intersection V may be spaced apart from the anchor and gusset panels 36*b*, 34*b*.

The third fold line 39*b* may intersect or pass through the notional vertex V. Notional extensions of the fourth and fifth fold lines 39*b*, 37*b* may intersect or pass through the notional vertex V.

The fifth fold line 37*b* may be interrupted by a "U" shaped cut line 43*b* to define a tab portion struck from material which would otherwise form the gusset panel 34*b*. The tab portion is integral with the anchor panel 36*b*.

The severance line 70 intersects with the third fold line 35*b* at a first intersection P. The first intersection P is disposed at a position closer to the gusset panel 34*b* than the notional intersection V of the first fold line 33*b* and second fold line 19.

Figure 16:
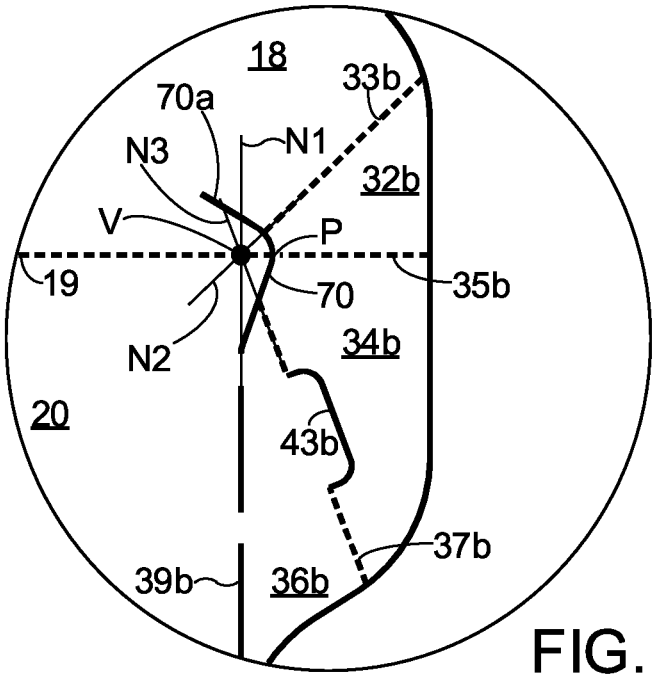
FIG. 16 is a plan view from above of a portion of a blank for forming a carton according to a ninth embodiment.

FIG. 16 illustrates an alternative embodiment of the corner folding arrangement shown in FIG. 1. In this embodiment the severance line 70 comprises an extension 70*a*, the extension 70*a* extends the severance line 70 further into the top panel 18. Whereas in the embodiment of FIG. 1 the severance line 70 terminates in the top panel 18 at a location substantially lying upon a notional extension N1 of the fourth fold line 39*b* in the ninth illustrated embodiment of FIG. 16 the extension 70*a* extends the severance line 70 beyond the notional extension N1 of fourth fold line 39*b*.

In alternative embodiments the severance line 70 may terminate at other locations, and may terminate at the end edge of the top panel 18 defined by the first fold line 33*b*. It some embodiments the severance line 70 may extend into the second side panel 20.

Folding of each upper tab is achieved during the erection of the carton. To form a top end closure structure out of each upper tab, the anchoring panel 26*a*, 26*b*, 36*a*, 36*b* is folded about 180 degrees to bring it into a face-contacting relationship with the inside surface of the adjacent side panel 16, 20. The anchoring panel 26*a*, 26*b*, 36*a*, 36*b* is held in the folded position by being pressed by one of the packaged articles B against the adjacent side panel 16, 20. The folding of the anchoring panel 26*a*, 26*b*, 36*a*, 36*b* causes the gusset panel 28*a*, 28*b*, 34*a*, 34*b* to be folded outwardly about the fold line 27*a*, 27*b*, 37*a*, 37*b* so that the gusset panel 28*a*, 28*b*, 34*a*, 34*b* extends outwardly from the fold line 27*a*, 27*b*, 37*a*, 37*b* along the side wall of the one packaged article B. At the same time, the web panel 30*a*, 30*b*, 32*a*, 32*b* is caused to fold downwardly along the fold line 31*a*, 31*b*, 33*a*, 33*b* and is thereby brought to a folded position where it extends between the fold line 31*a*, 31*b*, 33*a*, 33*b* and the outer edge of the gusset panel 28*a*, 28*b*, 34*a*, 34*b*. The top end closure structure thus completed is illustrated in FIG. 2 wherein the structure is shown as tightly engaging the top of the one article B.

Each lower projection serves to provide sufficient material in which the adjacent endmost heel aperture A3 is defined. More particularly, the heel aperture A3 adjacent to each lower projection is positioned such that sufficient material surrounds the heel aperture A3 even when the heel aperture A3 extends into that lower projection. During the erection and packaging of articles B, the blank 10 is manipulated so that each heel aperture A3 receives the bottom of a respective article B to retain said article B within the carton 90. The heel tabs 40 are also folded to assist in retaining the articles B.

Turning to the construction of the carton 90 as illustrated in FIG. 2, the carton 90 can be formed by a series of sequential folding operations in a straight line machine so that the carton 90 is not required to be rotated or inverted to complete its construction. The folding process is not limited to that described below and may be altered according to particular manufacturing requirements.

A group of articles B is assembled; in the embodiment illustrated in FIG. 2 six articles B are arranged in a 3×2 array. The top panel 18 of the blank 10 is disposed above the group of articles B to provide a top wall 18 of the carton 90.

The first and second side walls 16, 22 are folded, with respect to the top panel 18 about fold lines 17, 19 respectively, about opposing sides of the group of articles B so as to be disposed about the opposing sides of the group of articles B.

The anchor portions 26*a*, 26*b*, 36*a*, 36 may be folded into face contacting relationship with the respective one of the first and second side panel 16, 20 substantially simultaneously with folding the first and second side walls 16, 20 with respect to the top panel 18, to form the top end closure structures described above.

Alternatively, the top engaging structures may be formed subsequent to erection of the carton 90 into a tubular form. The anchor portions 26*a*, 26*b*, 36*a*, 36 may be tucked between the respective one of the first and second side panels 16, 20 to which they are hingedly connected and an adjacently disposed article B.

The first and second corner panels 14, 22 are folded, with respect to the respective one of the first and second side walls 16, 20 about fold lines 15, 21 respectively, about the heels or lower portions of adjacently disposed articles B.

The heel tabs 40 may folded out of the plane of the first and second corner panels 14, 22, about fold line 41, prior to folding the first and second corner panels 14, 22 the respective one of the first and second side walls 16, 20.

The second base panel 24 is folded about the fold line 23 so as to be disposed adjacent the base of the group of articles B, the first base panel 12 is then folded about the fold line 13 so as to be in at least partial overlapping relationship with the second base panel 24; in doing so each of the heel tabs 40 may be brought into engagement with a base of a respective article B.

The first and second base panels 12, 24 are secured together. Each of the male tabs M is displaced inwardly out of the plane of the first base panel 12. In so doing, each of the female tabs F is displaced inwardly creating a corresponding opening in the second base panel 24. The male tabs M are received in respective ones of the openings so as to lock the first and second base panels 12, 24 together. In this way a tubular structure is formed about the group of articles B.

The assembled carton 90, or at least a portion thereof, is shown in FIG. 2.

Referring now to FIGS. 3 to 5 there is shown an alternative embodiment of the present disclosure. In the second illustrated embodiment, like numerals have, where possible, been used to denote like parts, albeit with the addition of the prefix "100" to indicate that these features belong to the second embodiment.

Turning to FIG. 3, there is illustrated a blank 110 for forming a carton 190 according to a first embodiment. The blank 110 comprises a plurality of main panels 112, 114, 116, 118, 120, 122, 124 for forming a tubular structure. The plurality of main panels 112, 114, 116, 118, 120, 122, 124 comprises; a first base panel 112, a first lower side panel 114, a first upper side panel 116, a top panel 118, a second upper side panel 120, a second lower side panel 122, and a second base panel 124. The plurality of panels 112, 114, 116, 118, 120, 122, 124 may be arranged in a linear series hinged one to the next by corresponding fold lines 113, 115, 117, 119, 121, 123.

The first base panel 112 is hinged to the first lower side panel 114 by a hinged connection in the form of a fold line 113. The first lower side panel 114 is hinged to the first upper side panel 116 by a hinged connection in the form of a fold line 115. The first upper side panel 116 is hinged to the top panel 118 by a hinged connection in the form of a fold line 117. The top panel 118 is hinged to the second upper side panel 120 by a hinged connection in the form of a fold line 119. The second upper side panel 120 is hinged to the second lower side panel 122 by a hinged connection in the form of a fold line 121. The second lower side panel 122 is hinged to the second base panel 124 by a hinged connection in the form of a fold line 123.

The first upper side panel 116 and the first lower side panel 114 form a first side wall 114/116 of a carton 190. The second upper side panel 120 and the second lower side panel 122 form a second side wall 120/122 of a carton 190.

The blank 110 is foldable to form a package 190 as illustrated in FIGS. 4 and 5. The first and second base panels 112, 124 are engageable with one another in an overlapping relationship to form a composite base wall 112/124 of the carton 190. The blank 110 may comprise a complementary locking mechanism for securing the second base panel 124 to the first base panel 112 arranged substantially as described in respect of the first embodiment of FIG. 1.

The first and second base panels 112, 124 may comprise at least one first aperture A1. In the illustrated embodiment, the first base panel 112 comprises three first apertures A1, the second base panel 124 comprises two first apertures A1. The second base panel 124 may comprise at least one second aperture A2. In the illustrated embodiment, the second base panel 124 comprises one second aperture A2. The first and second apertures A1, A2 may be employed to facilitate construction of the carton 190.

The blank 110 comprises at least one end closure structure for at least partially closing an end of a tubular structure defined by the plurality of panels 112, 114, 116, 118, 120, 122, 124.

In the illustrated embodiment an end closure structure is provided for partially closing each end of the tubular structure.

Each of the end closure structures may be arranged to partially close an end of the tubular structure so as to provide or define a display window for the display of one or more articles B disposed adjacent thereto.

The blank 110 comprises a first end closure structure comprising a plurality of end closure panels 126*a*, 128*a*, 130*a*, 132*a*, 134*a*, 136*a*, 138*a*, 140*a*, 142*a*, 144*a*, 146*a*, 148*a*, 150*a*.

The first end closure structure comprises a first top end closure flap 138*a*/140*a* hingedly connected to the top panel 118 by a fold line 139*a*. The first top end closure flap 138*a*/140*a* comprises an upper part 138*a* hingedly connected to a lower part 140*a* by a hinged connection in the form of a fold line 141*a*.

A first upper end closure flap 134*a* is coupled to the first upper side panel 116 by a first upper web panel 132*a*. The first upper web panel 132*a* is hingedly connected to the first upper side panel 116 by a fold line 131*a*. The first upper end closure flap 134*a* is hingedly connected to the first web panel 132*a* by a fold line 133*a*.

The first upper end closure flap 134*a* is hingedly connected to first top end closure flap 138*a*/140*a* by a first gusset panel 136*a*. The first upper end closure flap 134*a* is hingedly connected to the first gusset panel 136*a* by a hinged connection in the form of a fold line 135*a*. The first gusset panel 136*a* is hingedly connected to the first top end closure flap 138*a*/140*a* by a hinged connection in the form of a fold line 137*a*.

The blank 110 comprises a corner folding arrangements at a first corner of the top panel 118 proximate the first gusset panel 136*a*, the corner folding arrangement is described in further detail below.

A second upper end closure flap 144*a* is coupled to the second upper side panel 120 by a second upper web panel 146*a*. The second upper web panel 146*a* is hingedly connected to the second upper side panel 120 by a fold line 147*a*. The second upper end closure flap 144*a* is hingedly connected to the second web panel 146*a* by a fold line 149*a*.

The second upper end closure flap 144*a* is hingedly connected to the first top end closure flap 138*a*/140*a* by a second gusset panel 142*a*. The second upper end closure flap 144*a* is hingedly connected to the second gusset panel 142*a* by a hinged connection in the form of a fold line 145*a*. The second gusset panel 142*a* is hingedly connected to the first top end closure flap 138*a*/140*a* by a hinged connection in the form of a fold line 143*a*.

The blank 110 comprises a corner folding arrangements at a second corner of the top panel 118 proximate the second gusset panel 142*a*, the corner folding arrangement is described in further detail below.

Optionally, the first end closure structure comprises a first lower side end closure flap 126*a* hingedly connected to the first lower side panel 114 by a first lower web panel 130*a*. The first lower side end closure flap 126*a* is hingedly connected to the first lower web panel 130*a* by a hinged connection in the form of a fold line 125*a*. The first lower web panel 130*a* is hingedly connected to the first lower side panel 114 by a hinged connection in the form of a fold line 129*a*.

Optionally, a second lower side end closure flap 150*a* is hinged to the second lower side panel 122 by a second lower web panel 148*a*. The second lower side end closure flap 150*a* is hingedly connected to the second lower web panel 148*a* by a hinged connection in the form of a fold line 153*a*. The second lower web panel 148*a* is hingedly connected to the second lower side panel 122 by a hinged connection in the form of a fold line 151*a*.

Optionally, a first bottom end closure flap 128*a* is hinged to the first base panel 112 by hinged connection in the form of a fold line 127*a*. The first lower side end closure flap 126*a*, second lower side end closure flap 150*a* and the first bottom end closure flap 128*a* are arranged to partially close a lower region of an open end of the tubular structure.

The blank 110 comprises a second end closure structure comprising a plurality of end closure panels 126*b*, 128*b*, 130*b*, 132*b*, 134*b*, 136*b*, 138*b*, 140*b*, 142*b*, 144*b*, 146*b*, 148*b*, 150*b*.

The second end closure structure comprises a second top end closure flap 138*b*/140*b* hingedly connected to the top panel 118, at a second end thereof, by a fold line 139*b*. The second top end closure flap 138*b*/140*b* comprises an upper part 138*b* hingedly connected to a lower part 140*b* by a hinged connection in the form of a fold line 141*b*.

A third upper end closure flap 134*b* is coupled to the first upper side panel 116 by a third web panel 132*b*. The third web panel 132*b* is hingedly connected to the first upper side panel 116 by a fold line 131*b*. The third upper end closure flap 134*b* is hingedly connected to the third web panel 132*b* by a fold line 133*b*.

The third upper end closure flap 134*b* is hingedly connected to second top end closure flap 138*b*/140*b* by a third gusset panel 136*b*. The third upper end closure flap 134*b* is hingedly connected to the third gusset panel 136*b* by a hinged connection in the form of a fold line 135*b*. The third gusset panel 136*b* is hingedly connected to the second top end closure flap 138*b*/140*b* by a hinged connection in the form of a fold line 137*b*.

The blank 110 comprises a corner folding arrangements at a third corner of the top panel 118 proximate the third gusset panel 136*b*, the corner folding arrangement is described in further detail below.

A fourth upper end closure flap 144*b* is coupled to the second upper side panel 120 by a fourth web panel 146*b*. The fourth web panel 146*b* is hingedly connected to the second upper side panel 120 by a fold line 147*b*. The fourth upper end closure flap 144*b* is hingedly connected to the fourth web panel 146*b* by a fold line 149*b*.

The fourth upper end closure flap 144*b* is hingedly connected to the second top end closure flap 138*b*/140*b* by a fourth gusset panel 142*b*. The fourth upper end closure flap 144*b* is hingedly connected to the fourth gusset panel 142*b* by a hinged connection in the form of a fold line 145*b*. The fourth gusset panel 142*b* is hingedly connected to the second top end closure flap 138*b*/140*b* by a hinged connection in the form of a fold line 143*b*.

The web panels 132*a*, 132*b*, 146*a*, 146*b* are optional and may be omitted, in such embodiments the fold lines 131*a*, 131*b*, 147*a*, 147*b* are omitted. The first, second, third and fourth upper end closure flap 134*a*, 134*b*, 144*a*, 144*b* is hinged directly to a respective one of the first and second upper side panels 116, 120.

Figure 3B:
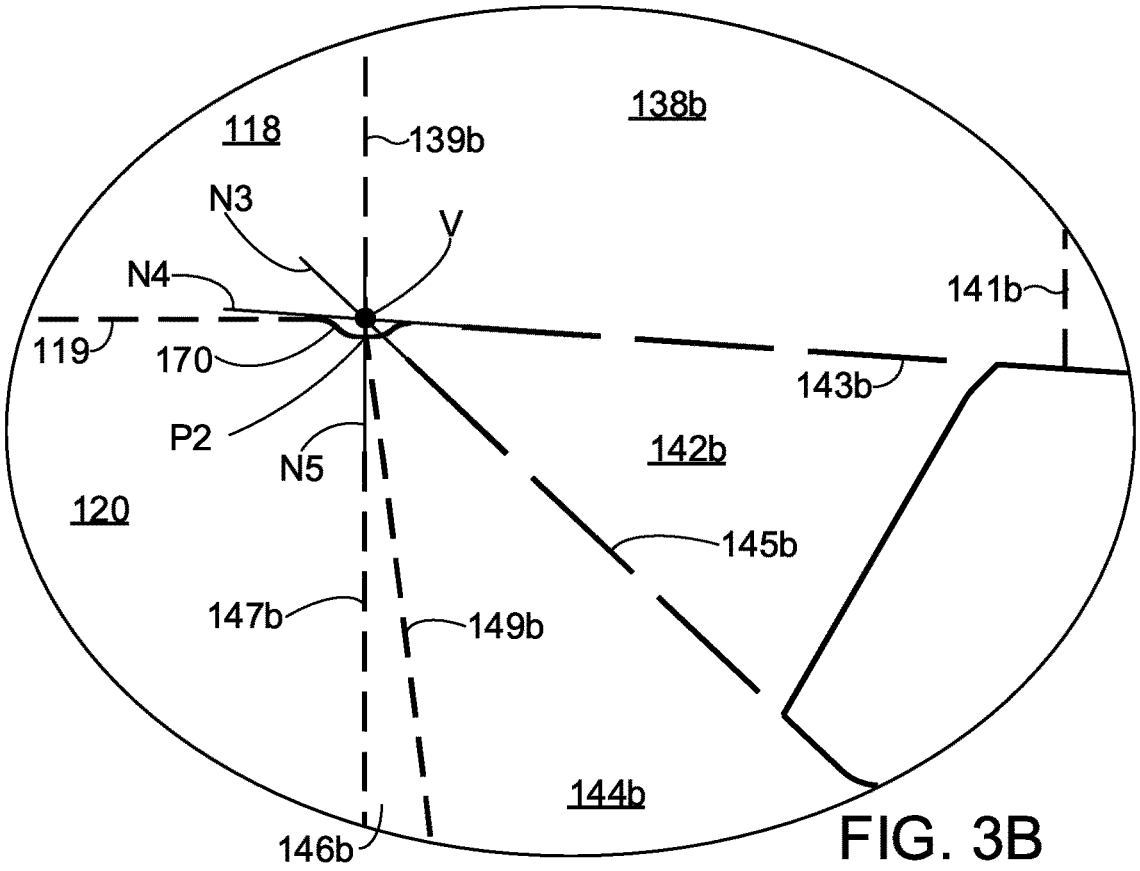
FIG. 3B is an enlarged view of a portion of the blank of FIG. 3.

The blank 110 comprises a fourth corner folding arrangement (best shown in FIG. 3B) at a fourth corner of the top panel 118 proximate the fourth gusset panel 142*b*, each of the corner folding arrangements are substantially the same in construction and will be described with regard to an enlarged view of the fourth corner arrangement shown in FIGS. 3 and 3B.

The fourth corner folding arrangement comprises a severance line 170 in the form of a cut line. The severance line 170 extends across or intersects the fold line 149*b* between the fourth upper end closure flap 144*b* and the fourth web panel 146*b*, the fold line 149*b* is also referred to herein as fourth fold line 149*b*.

The severance line 170 extends from the fold line 119 between the top panel 118 and the second side panel 120, the fold line 119 is also referred to herein as second fold line 119.

The severance line 170 extends towards the fold line 143*b* between the second top end closure flap 138*b*/140*b* and fourth gusset panel 142*b*. The severance line 170 may extend to the fold line 143*b*. The severance line 170 extends beyond or past the fold line 143*b* so as to extend into the second top end closure flap 138*b*/140*b*. The fold line 143*b* is also referred to herein as third fold line 143*b*.

The severance line 170 extends across or through the fold line 145*b* between the fourth gusset panel 142*b* and the fourth upper end closure flap 144*b*, this fold line is also referred to herein as fifth fold line 145*b*.

The fold line 139*b* between the top panel 118 and the second top end closure flap 138*b*/140*b* extends towards the severance line 170. The fold line 139*b* is also referred to herein as first fold line 139*b*.

The first and second fold lines 139*b*, 119 define a notional intersection or vertex V.

The severance line 170 can be considered to intersect or terminate each of the first, second, third, fourth and fifth fold lines 139*b*, 119, 143*b*, 149*b*, 145*b*.

The severance line 170 in the illustrated embodiment is non-linear and may be curvilinear. In other embodiments the severance line 170 may be defined by two or more linear sections divergently arranged with respect to each other. In still other embodiments the severance line 170 may be linear. In embodiments in which the severance line 170 is linear the severance line 170 may be divergently arranged with respect to at least the second and/or third fold lines 119, 143*b*.

The severance line 170 extends between the second fold line 119 and third fold line 143*b*.

The severance line 170 bypasses the notional intersection or vertex V such that the notional intersection V is located on one side of the severance line 170. The notional intersection V is located on a first side of the severance line 170 and the fourth upper end closure flap 144*b* and the fourth gusset panel 142*b* are located on a second, opposing, side of the severance line 170. The notional intersection V may be spaced apart from the fourth upper end closure flap 144*b* and the fourth gusset panel 142*b*.

The fourth fold line 149*b* may intersect or pass through the notional vertex V and may intersect or meet the first fold line 139*b*. Notional extensions N4, N3 of the third and fifth fold lines 143*b*, 145*b* may intersect or pass through the notional vertex V.

The severance line 170 intersects with the fourth fold line 149*b* at a first intersection P2. The first intersection P2 is disposed at a position closer to the fourth upper end closure flap 144*b* and/or the fourth gusset panel 142*b* than the notional intersection V of the first fold line 139*b* and second fold line 119.

Optionally, the first end closure structure comprises a third lower side end closure flap 126*b* hingedly connected to the first lower side panel 114 by a third lower web panel 130*b*. The third lower side end closure flap 126*b* is hingedly connected to the third lower web panel 130*b* by a hinged connection in the form of a fold line 125*b*. The third lower web panel 130*b* is hingedly connected to the first lower side panel 114 by a hinged connection in the form of a fold line 129*b*.

Optionally, a fourth lower side end closure flap 150*b* is hinged to the second lower side panel 122 by a fourth lower web panel 148*b*. The fourth lower side end closure flap 150*b* is hingedly connected to the fourth lower web panel 148*b* by a hinged connection in the form of a fold line 153*b*. The fourth lower web panel 148*b* is hingedly connected to the second lower side panel 122 by a hinged connection in the form of a fold line 151*b*.

Optionally, a second bottom end closure flap 128*b* is hinged to the first base panel 112 by hinged connection in the form of a fold line 127*b*. The third lower side end closure flap 126*b*, fourth lower side end closure flap 150*b* and the second bottom end closure flap 128*b* are arranged to partially close a lower region of an open end of the tubular structure.

The blank 110 comprises an optional carrying handle structure H. The handle structure H comprises a pair of foldable tabs 160*a*, 160*b*. The tabs 160*a*, 160*b* are spaced apart from each other. The tabs 160*a*, 160*b* are hingedly connected to the top panel 118 by fold lines 161*a*, 161*b* and are defined in part by a cut line or severance line 163*a*, 163*b*. Each of the severance lines 163*a*, 163*b* may extend into one or both of the first and second upper side panels 116, 120. The A first one of the tabs 160*a* is hingedly connected to the top panel 118 in opposition to a second one of the tabs 160*b*.

Turning to the construction of the carton 190 as illustrated in FIGS. 4 and 5, the carton 190 can be formed by a series of sequential folding operations in a straight line machine so that the carton 190 is not required to be rotated or inverted to complete its construction. The folding process is not limited to that described below and may be altered according to particular manufacturing requirements.

A group of articles B is assembled; in the preferred embodiment six articles B are arranged in a 3×2 array. The top panel 118 of the blank 110 is disposed above the group of articles B to provide a top wall 118 of the carton 190.

The first and second sidewalls 114/116, 120/122 are folded about the opposing sides of the group of articles B; the second base panel 124 is folded about the fold line 123 so as to be disposed adjacent the base of the group of articles B. The first base panel 112 is then folded about the fold line 113 so as to be in at least partial overlapping relationship with the second base panel 124. The first and second base panels 112, 124 are secured together. Each of the male tabs M is displaced inwardly out of the plane of the first base panel 112. In so doing, each of the female tabs F is displaced inwardly creating a corresponding opening in the second base panel 124. The male tabs M are received in respective ones of the openings so as to lock the first and second base panels 112, 124 together. In this way a tubular structure is formed about the group of articles B.

In some embodiments, the blank 110 may be formed into a tubular structure and subsequently loaded with articles B through at least one open end thereof.

The first and second end closure structures are folded about the open ends of the tubular structure. The folding sequence for each of the first and second end closure structures is substantially the same and will be described in more detail by reference to the first end closure structure only.

The first and second upper web panels 132*a*, 146*a* and first and second upper side end closure flaps 134*a*, 144*a* are folded about the fold lines 131*a*, 133*a*, 147, 149*a* a so as to partially close a first open end of the tubular structure.

The first and second gusset panels 136*a*, 142*a* at least partially fold in response to folding the first and second upper side end closure flaps 134*a*, 144*a*. The first top end closure panel 138*a*/140*a* folds, at least partially, in response to folding of the first and second gusset panels 136*a*, 142*a*.

The first and second gusset panels 136*a*, 142*a* are folded between the first top end closure panel 138*a*/140*a* and the respective one of first and second upper side end closure flaps 134*a*, 144*a* to which they are coupled.

The first top end closure panel 138*a*/140*a* is folded about fold line 139*a* to be brought in to face to face relationship with first and second upper side end closure flaps 134*a*, 144*a* and the first and second gusset panels 136*a*, 142*a*.

The second or lower part 140*a* of the first top end closure panel 138*a*/140*a* is folded, outwardly, with respect to the first or upper part 138*a* of the first top end closure panel 138*a*/140*a* by folding about fold line 141*a*.

Glue or other adhesive treatment is applied to each of the first and second upper side end closure flaps 134*a*, 144*a*. In other embodiments the glue may be applied to corresponding regions of an inner surface of the second part of the first top end closure panel 138*a*/140*a*.

The second part 140*a* of the first top end closure panel 138*a*/140*a* is unfolded with respect to the first part 138*a* of the first top end closure panel 138*a*/140*a* by folding about fold line 141*a* to bring the second part 140*a* of the first top end closure panel 138*a*/140*a* into face contacting relationship with the first and second upper side end closure flaps 134*a*, 144*a*.

The first top end closure panel 138*a*/140*a* is secured to the first and second upper side end closure flaps 134*a*, 144*a*.

The first and second lower web panels 130*a*, 148*a* first and second lower side end closure flaps 126*a*, 150*a* are folded about fold lines 125*a*, 129*a*, 151*a*, 153*a* respectively.

In some embodiments the first and second lower side end closure flaps 126*a*, 150*a* may be dimensioned so as to be arranged in an at least partial overlapping arrangement. The first lower side end closure flap 126*a* may be secured to the second lower side end closure flap 150*a*. Glue or other adhesive treatment may be applied to one of the first and second lower side end closure flaps 126*a*, 150*a* so as to secure them together.

Glue or other adhesive treatment is applied to each of the first and second lower side end closure flaps 126*a*, 150*a*. In other embodiments the glue may be applied to corresponding regions of an inner surface of the bottom end closure flap 128*a*.

The bottom end closure flap 128*a* is folded about fold line 127*a* so as to be brought up into face contacting relationship with the first and second lower side end closure flaps 126*a*, 150*a*.

The bottom end closure flap 128*a* is secured to the first and second lower side end closure flaps 126*a*, 150*a*.

Referring now to FIGS. 6 to 8 there is shown an alternative embodiment of the present disclosure. In the third illustrated embodiment, like numerals have, where possible, been used to denote like parts, albeit with the addition of the prefix "200" to indicate that these features belong to the third embodiment. The third embodiment shares many common features with the embodiment of FIGS. 3 to 5, therefore only the differences from the embodiment illustrated in FIGS. 3 to 4 will be described in any greater detail.

FIG. 3 shows a blank 210 for forming a carrier and comprises a plurality of main panels 212, 214, 216, 218, 220, 222, 224 for forming a tubular structure. The plurality of main panels 212, 214, 216, 218, 220, 222, 224 comprises; a first base panel 212, a first lower side panel 214, a first upper side panel 216, a top panel 218, a second upper side panel 220, a second lower side panel 222, and a second base panel 224. The plurality of panels 212, 214, 216, 218, 220, 222, 224 may be arranged in a linear series hinged one to the next by corresponding fold lines 213, 215, 217, 219, 221, 223.

The blank 210 comprises at least one end closure structure for at least partially closing an end of a tubular structure defined by the plurality of panels 212, 214, 216, 218, 220, 222, 224.

In the illustrated embodiment an end closure structure is provided for partially closing each end of the tubular structure.

Each of the end closure structures may be arranged to partially close an end of the tubular structure so as to provide or define a display window for the display of one or more articles B disposed adjacent thereto. Each of the end closure structures comprises two corner folding arrangements and the end closure structures substantially the same in construction and will be described in further detail with reference to the second end closure structure.

The blank 210 comprises a second end closure structure comprising a plurality of end closure panels 226*b*, 228*b*, 230*b*, 232*b*, 234*b*, 236*b*, 238*b*, 240*b*, 242*b*, 244*b*, 246*b*, 248*b*, 250*b*.

The second end closure structure comprises a second top end closure flap 238*b*/240*b* hingedly connected to the top panel 218, at a second end thereof, by a fold line 239*b*. The second top end closure flap 238*b*/240*b* comprises an upper part 238*b* hingedly connected to a lower part 240*b* by a hinged connection in the form of a fold line 241*b*.

A third upper end closure flap 234*b* is coupled to the first upper side panel 216 by a third web panel 232*b*. The third web panel 232*b* is hingedly connected to the first upper side panel 216 by a fold line 231*b*. The third upper end closure flap 234*b* is hingedly connected to the third web panel 232*b* by a fold line 233*b*.

The third upper end closure flap 234*b* is hingedly connected to second top end closure flap 238*b*/240*b* by a third gusset panel 236*b*. The third upper end closure flap 234*b* is hingedly connected to the third gusset panel 236*b* by a hinged connection in the form of a fold line 235*b*. The third gusset panel 236*b* is hingedly connected to the second top end closure flap 238*b*/240*b* by a hinged connection in the form of a fold line 237*b*.

The blank 210 comprises a corner folding arrangement at a third corner of the top panel 218 proximate the third gusset panel 236*b*, the corner folding arrangements provided in the blank 210 are substantially the same in construction and will be described in further detail with reference to a corner folding arrangement located at a fourth corner of the top panel 218.

A fourth upper end closure flap 244*b* is coupled to the second upper side panel 220 by a fourth web panel 246*b*. The fourth web panel 246*b* is hingedly connected to the second upper side panel 220 by a fold line 247*b*. The fourth upper end closure flap 244*b* is hingedly connected to the fourth web panel 246*b* by a fold line 249*b*.

The fourth upper end closure flap 244*b* is hingedly connected to the second top end closure flap 238*b*/240*b* by a fourth gusset panel 242*b*. The fourth upper end closure flap 244*b* is hingedly connected to the fourth gusset panel 242*b* by a hinged connection in the form of a fold line 245*b*. The fourth gusset panel 242*b* is hingedly connected to the second top end closure flap 238*b*/240*b* by a hinged connection in the form of a fold line 243*b*.

The web panels 232*a*, 232*b*, 246*a*, 246*b* are optional and may be omitted, in such embodiments the fold lines 231*a*, 231*b*, 247*a*, 247*b* are omitted. The first, second, third and fourth upper end closure flap 234*a*, 234*b*, 244*a*, 244*b* is hinged directly to a respective one of the first and second upper side panels 216, 220.

The blank 210 comprises a fourth corner folding arrangement (best shown in FIG. 7B) at a fourth corner of the top panel 218 proximate the fourth gusset panel 242*b*.

The fourth corner folding arrangement comprises a severance line 270 in the form of a cut line. The severance line 270 extends across or intersects the fold line 219 between the top panel 218 and the second side panel 220, this fold line is also referred to herein as second fold line 219.

The severance line 270 extends from the fold line 249*b* between the fourth web panel 246*b* and fourth upper end closure flap 244*b*, the fold line 249*b* is also referred to herein as fourth fold line 249*b*.

The severance line 270 extends towards the fold line 239*b* between the top panel 218 and the second top end closure flap 238*b*/240*b*. The severance line 270 may extend to the fold line 239*b* between the top panel 218 and the second top end closure flap 238*b*/240*b*. The severance line 270 extends beyond or past the fold line 239*b* between the top panel 218 and the second top end closure flap 238*b*/240*b* so as to extend into the top panel 218. The fold line 239*b* is also referred to herein as first fold line 239*b*.

The severance line 270 extends across or through the fold line 243*b* between the second top end closure flap 238*b*/240*b* and the fourth gusset panel 242*b*, this fold line is also referred to herein as third fold line 243*b*.

The severance line 270 extends across or through the fold line 245*b* between fourth upper end closure flap 244*b* and the fourth gusset panel 242*b*, this fold line is also referred to herein as fifth fold line 245*b*.

The severance line 270 can be considered to intersect or terminate each of the first, second, third, fourth and fifth fold lines 239*b*, 219, 243*b*, 249*b*, 245*b*.

The severance line 270 in the illustrated embodiment is non-linear and may be curvilinear. In other embodiments the severance line 270 may be defined by two or more linear sections divergently arranged with respect to each other. In still other embodiments the severance line 70 may be linear.

The severance line 270 extends between the first fold line 239*b* and fourth fold line 249*b*.

The severance line 270 bypasses a notional intersection or vertex V between a notional extension of the first fold line 239*b* and the second fold line 219 such that the notional intersection V is located on one side of the severance line 270. The notional intersection V is located on a first side of the severance line 270 and the fourth upper end closure flap 244*b* and the fourth gusset panel 242*b* are located on a second, opposing, side of the severance line 270. The notional intersection V may be spaced apart from the fourth upper end closure flap 244*b* and the fourth gusset panel 242*b*.

The fourth fold line 249*b*, or a notional extension thereof, may intersect or pass through the notional vertex V. Notional extensions N4, N3 of the third and fifth fold lines 243*b*, 245*b* may intersect or pass through the notional vertex V.

The severance line 270 intersects with the third fold line 243*b* at a first intersection P. The first intersection P is disposed at a position closer to the fourth upper end closure flap 244*b* and/or the fourth gusset panel 242*b* than the notional intersection V of the first fold line 239*b* and second fold line 219.

Figure 9:
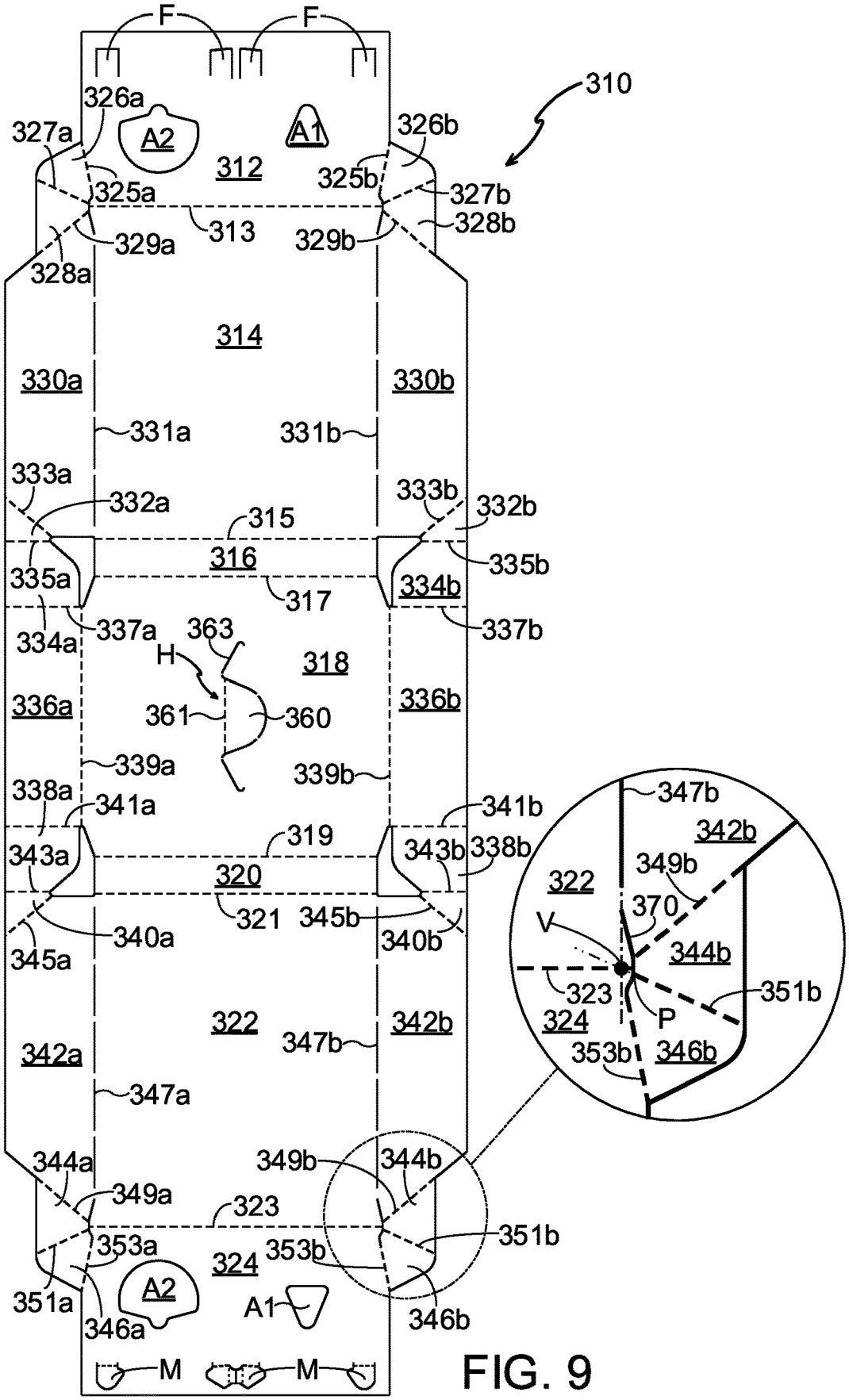
FIG. 9 is a plan view from above of a blank for forming a carton according to a fourth embodiment.
Figure 13A:
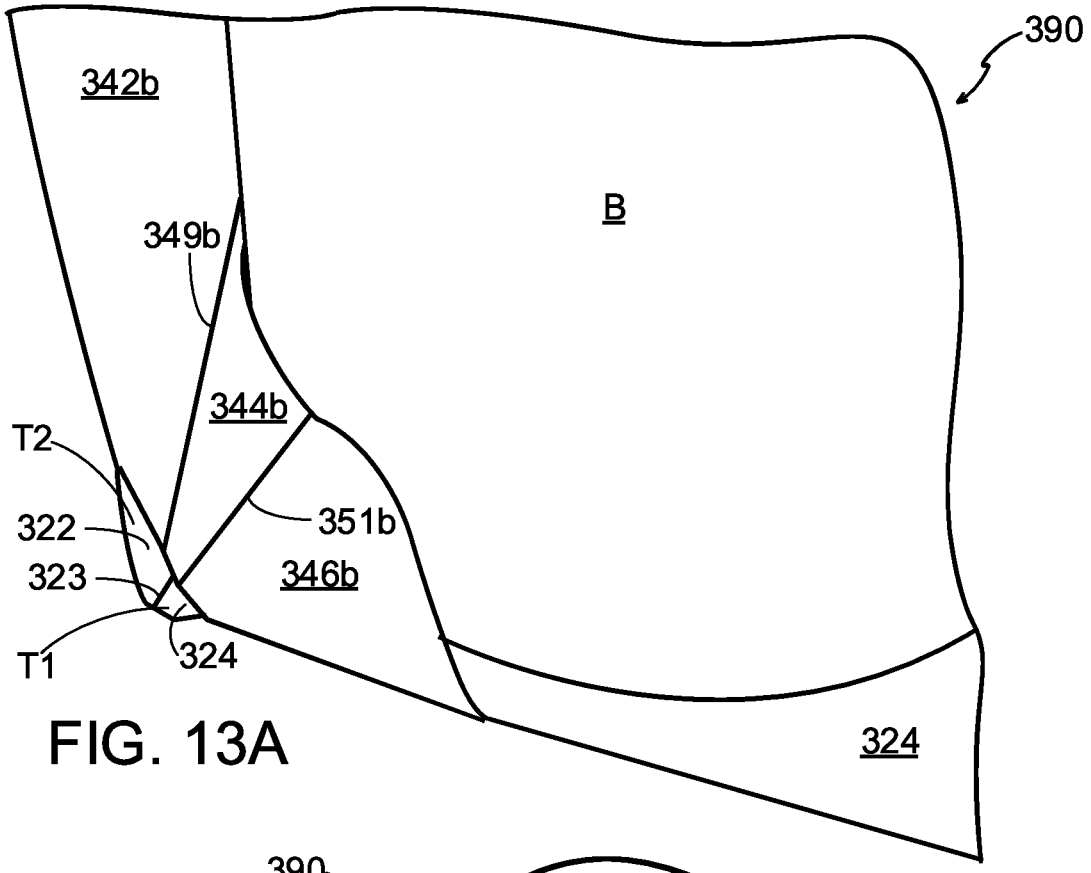
FIGS. 13A and 13B are perspective views from above of portions of a carrier formed from the blank of FIG. 9.
Figure 13B:
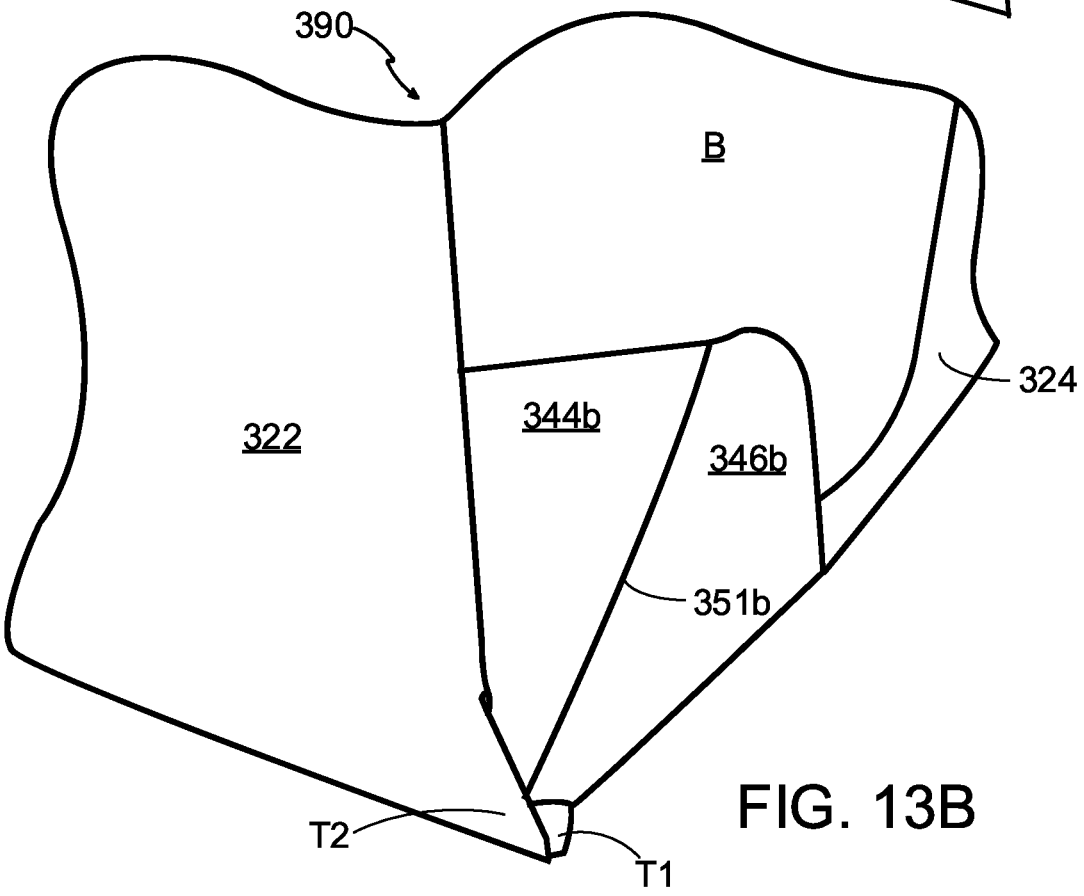

Referring now to FIGS. 9, 13A and 13B there is shown an alternative embodiment of the present disclosure. In the fourth illustrated embodiment, like numerals have, where possible, been used to denote like parts, albeit with the addition of the prefix "300" to indicate that these features belong to the fourth embodiment.

FIG. 9 shows a blank 310 for forming a carrier, the blank 310 comprises a plurality of main panels 312, 314, 316, 318, 320, 322, 324 for forming a tubular structure. The plurality of main panels 312, 314, 316, 318, 320, 322, 324 comprises; a first base panel 312, a first side panel 314, a first upper corner panel 316, a top panel 318, a second upper corner panel 320, a second side panel 322, and a second base panel 324. The plurality of main panels 312, 314, 316, 318, 320, 322, 324 may be arranged in a linear series hinged one to the next by corresponding fold lines 313, 315, 317, 319, 321, 323.

The first and second upper corner panels 316, 320 may be considered to form part of a top wall of the carrier 390 along with the top panel 318. Alternatively, the first and second upper corner panels 316, 320 may be considered to form an upper portion of a respective one of the first and second side panels 314, 322.

In some embodiments the first and second upper corner panels 316, 320 may be omitted, in such embodiments the fold lines 315 and 321 may be omitted.

The blank 310 may comprise a complementary locking mechanism for securing the second base panel 324 to the first base panel 312. The second base panel 324 may comprise at least one first part M of the complementary locking mechanism. The first base panel 312 may comprise at least one second part F of the complementary locking mechanism.

The first and second base panels 312, 324 may comprise at least one first aperture A1. In the illustrated embodiment, the first base panel 312 comprises one first aperture A1, the second base panel 324 comprises one first aperture A1. The first and second base panels 312, 324 may comprise at least one second aperture A2. In the illustrated embodiment, the first base panel 312 comprises one second aperture A2 and the second base panel 324 comprises one second aperture A2. The first and second apertures A1, A2 may be employed to facilitate construction of the carton 390.

The blank 310 comprises an optional carrying handle structure H. The handle structure H comprises a single foldable tab 360. The tab 360 is hingedly connected to the top panel 318 by a fold line 361 and is defined in part by a cut line or severance line 363.

The blank 310 comprises at least one end closure structure for at least partially closing an end of a tubular structure defined by the plurality of panels 312, 314, 316, 318, 320, 322, 324. The blank 310 comprises a first end closure structure comprising a plurality of end closure panels 326*a*, 328*a*, 330*a*, 332*a*, 334*a*, 336*a*, 338*a*, 340*a*, 342*a*, 344*a*, 346*a*.

The first end closure structure comprises a first top end closure flap 336*a* hingedly connected to the top panel 318 by a fold line 339*a*.

A first bottom end closure flap 336*a* is hingedly connected to the first base panel 312 by a hinged connection in the form of a fold line 325*a*.

A first gusset panel 328*a* is hingedly connected to the first bottom end closure flap 336*a* by a hinged connection in the form of a fold line 327*a*.

A first anchor panel 330*a* is hingedly connected to the first gusset panel 328*a* by a hinged connection in the form of a fold line 329*a*. The first anchor panel 330*a* is hingedly connected to the first side panel 314 by a hinged connection in the form of a fold line 331*a*.

A first corner end closure flap 334*a* is hingedly connected to the first top end closure flap 336*a* by a hinged connection in the form of a fold line 337*a*. The first corner end closure flap 334*a* is hingedly connected to a second gusset panel 332*a* by a hinged connection in the form of a fold line 335*a*. The second gusset panel 332*a* is hingedly connected to the first anchor panel 330*a* by a hinged connection in the form of a fold line 333*a*.

A second corner end closure flap 338*a* is hingedly connected to the first top end closure flap 336*a* by a hinged connection in the form of a fold line 341*a*. The second corner end closure flap 338*a* is hingedly connected to a third gusset panel 340*a* by a hinged connection in the form of a fold line 343*a*.

The second gusset panel 332*a* is hingedly connected to a second anchor panel 342*a* by a hinged connection in the form of a fold line 345*a*. The second anchor panel 342*a* is hingedly connected to the second side panel 322 by a hinged connection in the form of a fold line 347*a*.

A fourth gusset panel 344*a* is hingedly connected to the second anchor panel 342*a* by a hinged connection in the form of a fold line 349*a*.

A second bottom end closure flap 346*a* is hingedly connected to the second base panel 324 by a hinged connection in the form of a fold line 353*a*. The second bottom end closure flap 346*a* is hingedly connected to the fourth gusset panel 344*a* by a hinged connection in the form of a fold line 351*a*.

The blank 310 comprises a second end closure structure comprising a plurality of end closure panels 326*b*, 328*b*, 330*b*, 332*b*, 334*b*, 336*b*, 338*b*, 340*b*, 342*b*, 344*b*, 346*b*. The second end closure structure comprises a second top end closure flap 336*b* hingedly connected to the top panel 318 by a fold line 339*b*.

A third bottom end closure flap 336*b* is hingedly connected to the first base panel 312 by a hinged connection in the form of a fold line 325*b*.

A fifth gusset panel 328*b* is hingedly connected to the third bottom end closure flap 336*b* by a hinged connection in the form of a fold line 327*b*.

A third anchor panel 330*b* is hingedly connected to the fifth gusset panel 328*b* by a hinged connection in the form of a fold line 329*b*. The third anchor panel 330*b* is hingedly connected to the first side panel 314 by a hinged connection in the form of a fold line 331*b*.

A third corner end closure flap 334*b* is hingedly connected to the second top end closure flap 336*b* by a hinged connection in the form of a fold line 337*b*. The third corner end closure flap 334*b* is hingedly connected to a sixth gusset panel 332*b* by a hinged connection in the form of a fold line 335*b*. The sixth gusset panel 332*b* is hingedly connected to the third anchor panel 330*b* by a hinged connection in the form of a fold line 333*b*.

A fourth corner end closure flap 338*b* is hingedly connected to the second top end closure flap 336*b* by a hinged connection in the form of a fold line 341*b*. The fourth corner end closure flap 338*b* is hingedly connected to a seventh gusset panel 340*b* by a hinged connection in the form of a fold line 343*b*. The seventh gusset panel 332*b* is hingedly connected to a fourth anchor panel 342*b* by a hinged connection in the form of a fold line 345*b*. The fourth anchor panel 342*b* is hingedly connected to the second side panel 322 by a hinged connection in the form of a fold line 347*b*.

An eighth gusset panel 344*b* is hingedly connected to the fourth anchor panel 342*b* by a hinged connection in the form of a fold line 349*b*.

A fourth bottom end closure flap 346*b* is hingedly connected to the second base panel 324 by a hinged connection in the form of a fold line 353*b*. The fourth bottom end closure flap 346*b* is hingedly connected to the eighth gusset panel 344*b* by a hinged connection in the form of a fold line 351*b*.

The blank 310 comprises four corner folding arrangements, a first pair of corner folding arrangements are located at corners of the first base panel 312 adjacent to the first side panel 314. A second pair of corner folding arrangements are located at corners of the second base panel 324 adjacent to the second side panel 322. The corner folding arrangements are substantially the same and will be described with regard to an enlarged view of one of the corner arrangements between the second base panel 324 and the second side panel 322 an enlarged view of which is shown in FIG. 9.

The corner folding arrangement comprises a severance line 370 in the form of a cut line. The severance line 370 extends across or intersects the fold line 323 between the second base panel 324 and the second side panel 322, this fold line is also referred to herein as second fold line 323.

The severance line 370 extends from the fold line 347*b* between the second side panel 322 and the fourth anchor panel 342*b*, the fold line 347*b* is also referred to herein as fourth fold line 347*b*.

The severance line 370 extends towards the fold line 353*b* between the second base panel 324 and the fourth bottom end closure flap 346*b*. The severance line 370 may extend to the fold line 353*b* between the second base panel 324 and the fourth bottom end closure flap 346*b*. The severance line 370 extends beyond or past the fold line 353*b* between the second base panel 324 and the fourth bottom end closure flap 346*b* so as to extend into the second base panel 324. The fold line 353*b* is also referred to herein as first fold line 353*b*.

The severance line 370 extends across or through the fold line 351*b* between the fourth bottom end closure flap 346*b* and the eighth gusset panel 344*b*, this fold line is also referred to herein as third fold line 351*b*.

The severance line 370 extends across or through the fold line 349*b* between the fourth anchor panel 342*b* and the eighth gusset panel 344*b*, this fold line is also referred to herein as fifth fold line 349*b*.

The severance line 370 can be considered to intersect or terminate each of the first, second, third, fourth and fifth fold lines 353*b*, 323, 351*b*, 347*b*, 349*b*.

The severance line 370 in the illustrated embodiment is non-linear and may be curvilinear. In other embodiments the severance line 370 may be defined by two or more linear sections divergently arranged with respect to each other. In still other embodiments the severance line 370 may be linear.

The severance line 370 extends between the first fold line 353*b* and fourth fold line 347*b*.

The severance line 370 bypasses a notional intersection or vertex V between a notional extension of the first fold line 353*b* and the second fold line 323 such that the notional intersection V is located on one side of the severance line 370. The notional intersection V is located on a first side of the severance line 370; the fourth anchor panel 342*b* and the eighth gusset panel 344*b* are located on a second, opposing, side of the severance line 370. The notional intersection V may be spaced apart from the fourth anchor panel 342*b* and from the eighth gusset panel 344*b*.

The third fold line 351*b*, or a notional extension thereof, may intersect or pass through the notional vertex V. Notional extensions of the fourth and fifth fold lines 347*b*, 349*b* may intersect or pass through the notional vertex V.

The severance line 370 intersects with the third fold line 351*b* at a first intersection P. The first intersection P is disposed at a position closer to the eighth gusset panel 344*b* than the notional intersection V of the first fold line 353*b* and second fold line 323.

Figure 10:
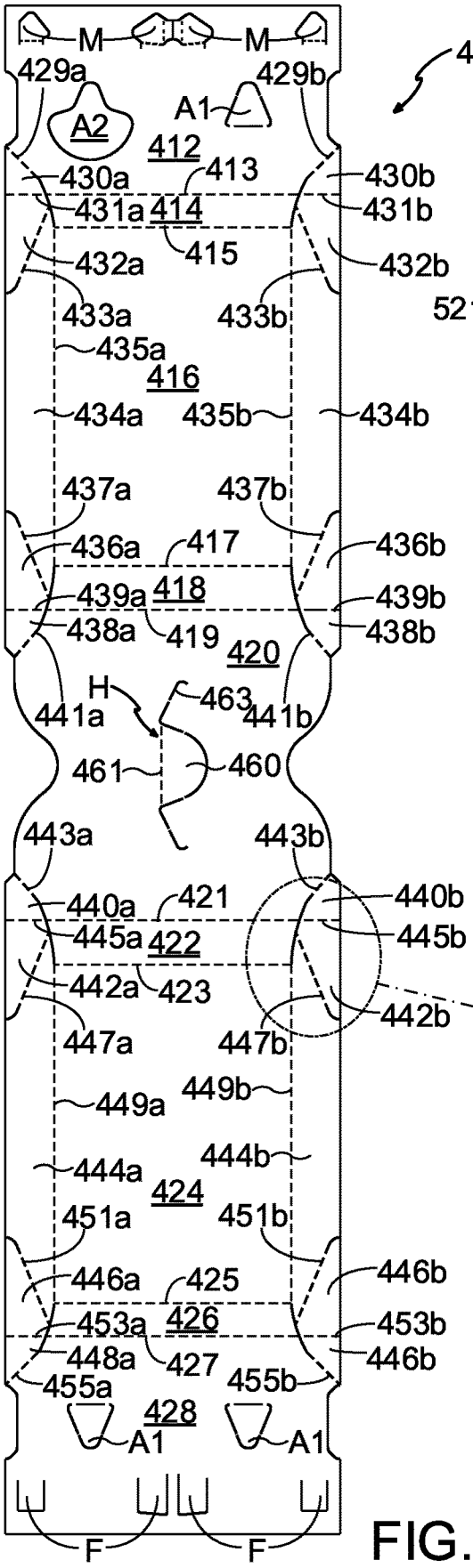
FIG. 10 is a plan view from above of a blank for forming a carton according to a fifth embodiment.
Figure 10C:
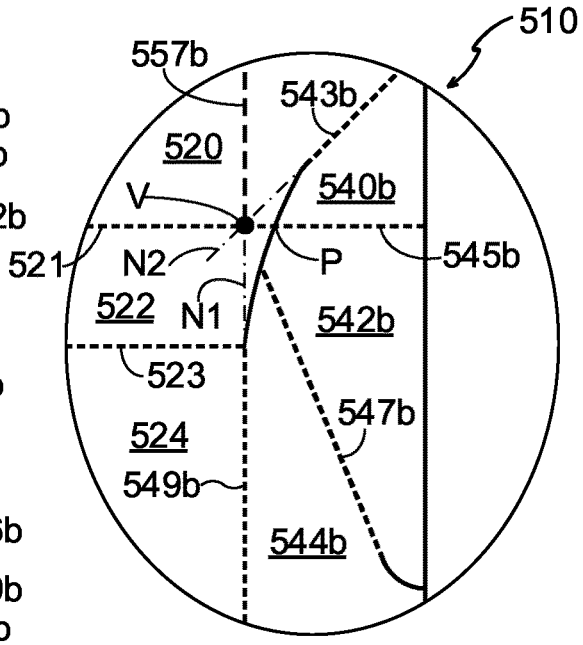
FIG. 10C is a plan view from above of a portion of a blank for forming a carton according to a sixth embodiment.
Figure 10B:
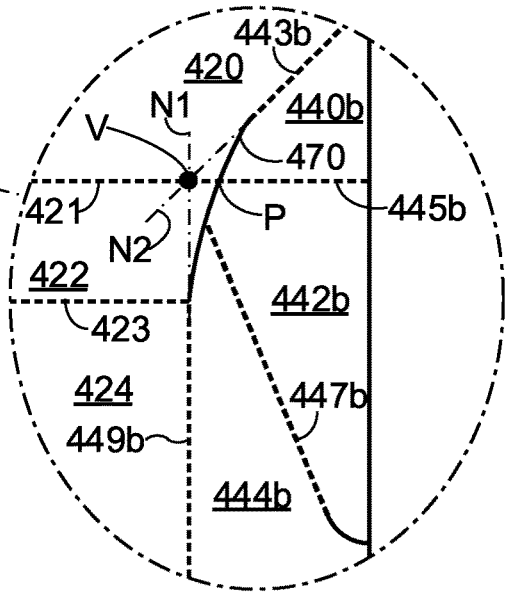
FIG. 10B is an enlarged view of a portion of the blank of FIG. 10.
Figure 14:
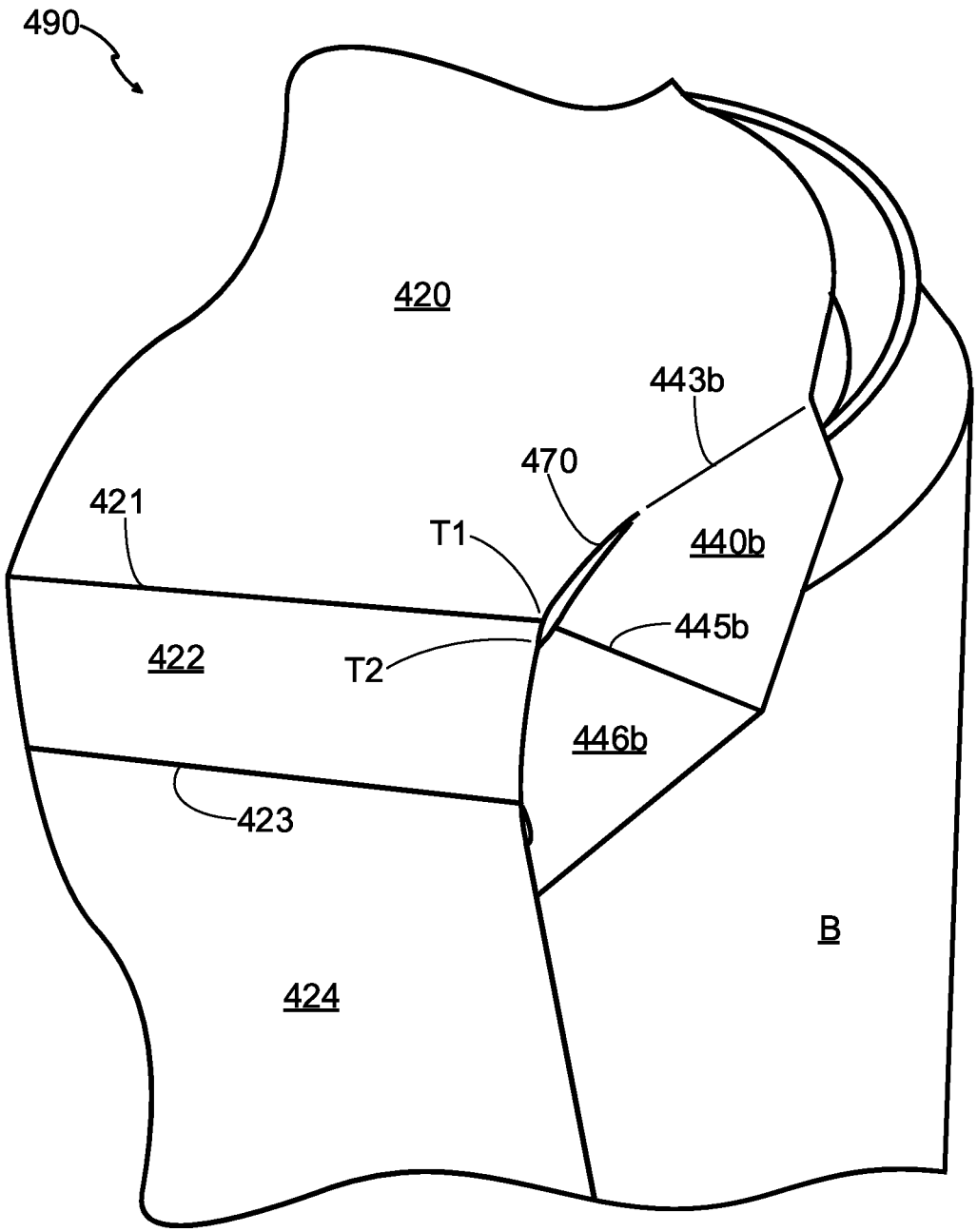
FIG. 14 is a perspective view from above of a portion of a carton formed from the blank of FIG. 10A.

Referring now to FIGS. 10A, 10B and 14 there is shown an alternative embodiment of the present disclosure. In the fifth illustrated embodiment, like numerals have, where possible, been used to denote like parts, albeit with the addition of the prefix "400" to indicate that these features belong to the fifth embodiment.

FIG. 10A shows a blank 410 for forming a carrier, the blank 410 comprises a plurality of main panels 412, 414, 416, 418, 420, 422, 424, 426, 428 for forming a tubular structure. The plurality of main panels 412, 414, 416, 418, 420, 422, 424, 426, 428 comprises; a first base panel 412, a first lower corner panel 414, a first side panel 416, a first upper corner panel 418, a top panel 420, a second upper corner panel 422, a second side panel 424, a second lower corner panel 426 and a second base panel 428. The plurality of main panels 412, 414, 416, 418, 420, 422, 424, 426, 428 may be arranged in a linear series hinged one to the next by corresponding fold lines 413, 415, 417, 419, 421, 423, 425, 427.

The first and second upper corner panels 418, 422 may be considered to form part of a top wall of the carrier 490 along with the top panel 420. Alternatively, the first and second upper corner panels 416, 424 may be considered to form an upper portion of a respective one of the first and second side panels 416, 424.

The first and second lower corner panels 414, 426 may be considered to form part of a bottom wall of the carrier 490 along with the first and second base panels 412, 428. Alternatively, the first and second lower corner panels 414, 426 may be considered to form a lower portion of a respective one of the first and second side panels 416, 424.

In some embodiments the first and second upper corner panels 418, 422 may be omitted, in such embodiments the fold lines 317 and 323 may be omitted. In some embodiments the first and second lower corner panels 414, 426 may be omitted, in such embodiments the fold lines 415 and 425 may be omitted.

The blank 410 may comprise a complementary locking mechanism for securing the second base panel 428 to the first base panel 412. The first base panel 412 may comprise at least one first part M of the complementary locking mechanism. The second base panel 428 may comprise at least one second part F of the complementary locking mechanism.

The first and second base panels 412, 428 may comprise at least one first aperture A1. In the illustrated embodiment, the first base panel 412 comprises one first aperture A1, the second base panel 428 comprises one first aperture A1. The first and second base panels 412, 428 may comprise at least one second aperture A2. In the illustrated embodiment, the first base panel 412 comprises one second aperture A2 and the second base panel 428 comprises one second aperture A2. The first and second apertures A1, A2 may be employed to facilitate construction of the carton 490.

The blank 410 comprises an optional carrying handle structure H. The handle structure H comprises a single foldable tab 460. The tab 460 is hingedly connected to the top panel 420 by a fold line 461 and is defined in part by a cut line or severance line 463.

The blank 410 comprises at least one end closure structure for at least partially closing an end of a tubular structure defined by the plurality of panels 412, 414, 416, 418, 420, 422, 424, 426, 428.

The blank 410 comprises a first end closure structure comprising a plurality of end closure panels 430*a*, 432*a*, 434*a*, 436*a*, 438*a*, 440*a*, 442*a*, 444*a*, 446*a*, 448*a*. The first end closure structure comprises a first bottom end closure flap 430*a* is hingedly connected to the first base panel 412 by a hinged connection in the form of a fold line 429*a*.

A first gusset panel 432*a* is hingedly connected to the first bottom end closure flap 430*a* by a hinged connection in the form of a fold line 431*a*.

A first anchor panel 434*a* is hingedly connected to the first gusset panel 432*a* by a hinged connection in the form of a fold line 433*a*. The first anchor panel 434*a* is hingedly connected to the first side panel 416 by a hinged connection in the form of a fold line 435*a*.

A second gusset panel 436*a* is hingedly connected to the first anchor panel 434*a* by a hinged connection in the form of a fold line 437*a*.

A first top end closure flap 438*a* is hingedly connected to the second gusset panel 436*a* by a hinged connection in the form of a fold line 439*a*. The first top end closure flap 438*a* is hingedly connected to the top panel 420 by a hinged connection in the form of a fold line 441*a*. The first end closure structure comprises a second bottom end closure flap 448*a* is hingedly connected to the second base panel 428 by a hinged connection in the form of a fold line 455*a*.

A third gusset panel 446*a* is hingedly connected to the first bottom end closure flap 448*a* by a hinged connection in the form of a fold line 453*a*.

A second anchor panel 444*a* is hingedly connected to the third gusset panel 446*a* by a hinged connection in the form of a fold line 451*a*.

A fourth gusset panel 442*a* is hingedly connected to the second anchor panel 444*a* by a hinged connection in the form of a fold line 447*a*.

The second anchor panel 444*a* is hingedly connected to the second side panel 424 by a hinged connection in the form of a fold line 449*a*.

A second top end closure flap 440*a* is hingedly connected to the fourth gusset panel 442*a* by a hinged connection in the form of a fold line 445*a*. The second top end closure flap 440*a* is hingedly connected to the top panel 420 by a hinged connection in the form of a fold line 443*a*.

The blank 410 comprises a second end closure structure comprising a plurality of end closure panels 430*b*, 432*b*, 434*b*, 436*b*, 438*b*, 440*b*, 442*b*, 444*b*, 446*b*, 448*b*. The second end closure structure comprises a third bottom end closure flap 430*b* is hingedly connected to the first base panel 412 by a hinged connection in the form of a fold line 429*b*.

A fifth gusset panel 432*b* is hingedly connected to the first bottom end closure flap 430*b* by a hinged connection in the form of a fold line 431*b*.

A third anchor panel 434*b* is hingedly connected to the fifth gusset panel 432*b* by a hinged connection in the form of a fold line 433*b*. The third anchor panel 434*b* is hingedly connected to the first side panel 416 by a hinged connection in the form of a fold line 435*b*.

A sixth gusset panel 436*b* is hingedly connected to the third anchor panel 434*b* by a hinged connection in the form of a fold line 437*b*.

A third top end closure flap 438*b* is hingedly connected to the sixth gusset panel 436*b* by a hinged connection in the form of a fold line 439*b*. The third top end closure flap 438*b* is hingedly connected to the top panel 420 by a hinged connection in the form of a fold line 441*b*. The first end closure structure comprises a fourth bottom end closure flap 448*b* is hingedly connected to the second base panel 428 by a hinged connection in the form of a fold line 455*b*.

A seventh gusset panel 446*b* is hingedly connected to the first bottom end closure flap 448*b* by a hinged connection in the form of a fold line 453*b*.

A fourth anchor panel 444*b* is hingedly connected to the seventh gusset panel 446*b* by a hinged connection in the form of a fold line 451*b*. The fourth anchor panel 444*b* is hingedly connected to the second side panel 424 by a hinged connection in the form of a fold line 449*b*.

An eighth gusset panel 442*b* is hingedly connected to the fourth anchor panel 444*b* by a hinged connection in the form of a fold line 447*b*.

A fourth top end closure flap 440*b* is hingedly connected to the eighth gusset panel 442*b* by a hinged connection in the form of a fold line 445*b*. The fourth top end closure flap 440*b* is hingedly connected to the top panel 420 by a hinged connection in the form of a fold line 443*b*.

The blank 410 comprises eight corner folding arrangements, a first pair of corner folding arrangements are located at corners of the first base panel 412 adjacent to the first side panel 416 or the first corner panel 414 when present. A second pair of corner folding arrangements are located at corners of the second base panel 428 adjacent to the second side panel 424 or the fourth corner panel 426 when present.

A third pair of corner folding arrangements are located at corners of the top panel 420 adjacent to the first side panel 416 or the second corner panel 418 when present. A fourth pair of corner folding arrangements are located at corners of the top panel 420 adjacent to the second side panel 424 or the third corner panel 422 when present.

The corner folding arrangements are substantially the same and will be described with regard to an enlarged view of one of the corner arrangements between the top panel 420, the second side panel 424 and the third corner panel 422 an enlarged view of which is shown in FIG. 10B.

The corner folding arrangement comprises a severance line 470 in the form of a cut line. The severance line 470 extends across or intersects the fold line 421 between the third corner panel 422 and the top panel 420, this fold line is also referred to herein as second fold line 421.

The severance line 470 extends from the fold line 449*b* between the second side panel 424 and the fourth anchor panel 444*b*, the fold line 449*b* is also referred to herein as fourth fold line 449*b*.

In the illustrate embodiment the fold line 423 between the third corner panel 422 and the second side panel 424 intersects or terminates at the point of contact between severance line 470 and the fold line 449*b*. In some embodiments the fold line 423 may not contact the vertex between severance line 470 and the fold line 449*b* but may be aligned such that a notional linear extension thereof passes through said vertex.

The severance line 470 extends towards the fold line 443*b* between the top panel 420 and the fourth top end closure flap 440*b*. The severance line 470 may extend to the fold line 443*b* between the top panel 420 and the fourth top end closure flap 440*b*. The severance line 470 extends beyond or past the fold line 443*b* between the top panel 420 and the fourth top end closure flap 440*b* so as to extend into the fourth top end closure flap 440*b*. The fold line 443*b* is also referred to herein as first fold line 443*b*.

The severance line 470 extends across or through the fold line 445*b* between the fourth top end closure flap 440*b* and the eighth gusset panel 442*b*, this fold line is also referred to herein as third fold line 445*b*.

The severance line 470 extends across or through the fold line 447*b* between the fourth anchor panel 444*b* and the eighth gusset panel 442*b*, this fold line is also referred to herein as fifth fold line 447*b*.

The severance line 470 can be considered to intersect or terminate each of the first, second, third, fourth and fifth fold lines 443*b*, 421, 445*b*, 449*b*, 447*b*.

The severance line 470 in the illustrated embodiment is non-linear and may be curvilinear. In other embodiments the severance line 470 may be defined by two or more linear sections divergently arranged with respect to each other. In still other embodiments the severance line 470 may be linear.

The severance line 470 extends between the first fold line 443*b* and fourth fold line 449*b*.

The severance line 470 bypasses a notional intersection or vertex V between a notional extension N2 of the first fold line 443*b* and the second fold line 421 such that the notional intersection V is located on one side of the severance line 470. The notional intersection V is located on a first side of the severance line 470; the fourth anchor panel 444*b* and the eighth gusset panel 442*b* are located on a second, opposing, side of the severance line 470. The notional intersection V may be spaced apart from the fourth anchor panel 444*b* and from the eighth gusset panel 442*b*.

The severance line 470 appears concave when viewed from the second side. In contrast the severance lines 70; 170; 270; 370 of the foregoing embodiments appear convex when viewed from the second side.

The third fold line 445*b*, or a notional extension thereof, may intersect or pass through the notional vertex V. Notional extensions of the fourth and fifth fold lines 449*b*, 447*b* may intersect or pass through the notional vertex V.

The severance line 470 intersects with the third fold line 445*b* at a first intersection P. The first intersection P is disposed at a position closer to the eighth gusset panel 442*b* than the notional intersection V of the first fold line 443*b* and second fold line 421.

Referring now to FIG. 10C there is shown an alternative embodiment of the present disclosure. In the sixth illustrated embodiment, like numerals have, where possible, been used to denote like parts, albeit with the addition of the prefix "500" to indicate that these features belong to the sixth embodiment. The sixth embodiment shares many common features with the embodiment of FIGS. 10A, 10B and 14, therefore only the differences from the embodiment illustrated in FIGS. 10A, 10B and 14 will be described in any greater detail.

FIG. 10C illustrate a portion of a blank 510. The blank 510 comprises at least one corner folding arrangement, substantially similar in arrangement to the corner folding arrangement of the embodiment of FIG. 10. In the embodiment of FIG. 10C the corner folding arrangement comprises an additional fold line 557*b*. The fold line 557*b* is provided in the top panel 520 and may extend substantially perpendicular to the second fold line 521. The fold line 557*b* may extend substantially collinearly with the fourth fold line 549*b*. The fold line 557*b* may extend towards or intersect with the second fold line 521 at the notional vertex V defined by a notional extension N2 of the first fold line 543*b* and the second fold line 521.

Figure 17:
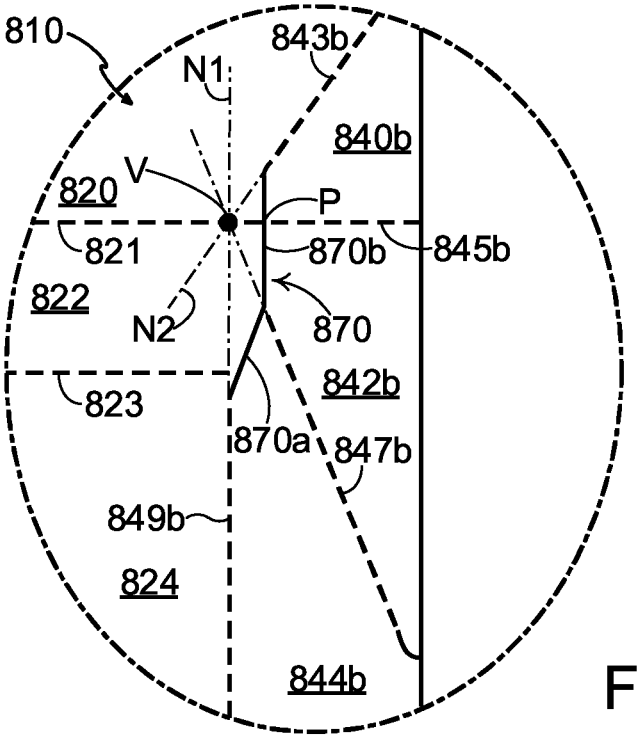
FIG. 17 is a plan view from above of a portion of a blank for forming a carton according to a tenth embodiment.

Referring now to FIG. 17 there is shown an alternative embodiment of the present disclosure. In the tenth illustrated embodiment, like numerals have, where possible, been used to denote like parts, albeit with the addition of the prefix "800" to indicate that these features belong to the tenth embodiment. The tenth embodiment shares many common features with the embodiment of FIGS. 10A, 10B and 14, therefore only the differences from the embodiment illustrated in FIGS. 10A, 10B and 14 will be described in any greater detail.

FIG. 17 illustrate a portion of a blank 810. The blank 810 comprises at least one corner folding arrangement, substantially similar in arrangement to the corner folding arrangement of the embodiment of FIG. 10. In the embodiment of FIG. 17 the corner folding arrangement comprises a non-linear severance line 870. The severance line 870 separates the top panel 820 from the fourth top end closure flap 840*b* and separates the third corner panel 822 from the eighth gusset panel 842*b* and the fourth anchoring panel 844*b*.

The severance line 870 extends from the fold line 849*b* (also referred to herein as fourth fold line 849*b*) between the second side panel 824 and the fourth anchor panel 844*b* and comprises a first linear section 870*a* obliquely oriented with respect to the fourth fold line 849*b*.

The severance line 870 comprises a second linear section 870*b* continuous with the first linear section 870*a*. The second section 870*b* is divergently arranged with respect to the first linear section 870*a* so as to define a non-linear cut. The second section 870*b* may be oriented substantially perpendicular to the third fold line 845*b*.

The second section 870*b* extends across or intersects the fold line 821 between the third corner panel 822 and the top panel 820.

The second section 870*b* extends across or intersects the third fold line 845*b* between the fourth top end closure flap 840*b* and the eighth gusset panel 842*b*.

The notional vertex V defined by a notional extension N2 of the first fold line 843*b* and the second fold line 821 is disposed on a first side of the second section 870*b* of the severance line 870. The notional vertex V is spaced apart from the second section 870*b* of the severance line 870.

The second section 870*b* of the severance line 870 intersects or traverses the third fold line 845*b* at a point of intersection P. The point of intersection P is spaced apart from the notional vertex V.

The second section 870*b* may terminate or intersect the first fold line 843*b*.

In the embodiment of FIG. 17 the fold line 823 between the third corner pane 1822 and the second side panel 824 is disposed closer to the second fold line 821 than a the point of intersection between the first section 870*a* and the fourth fold line 849*b*.

Figure 11:
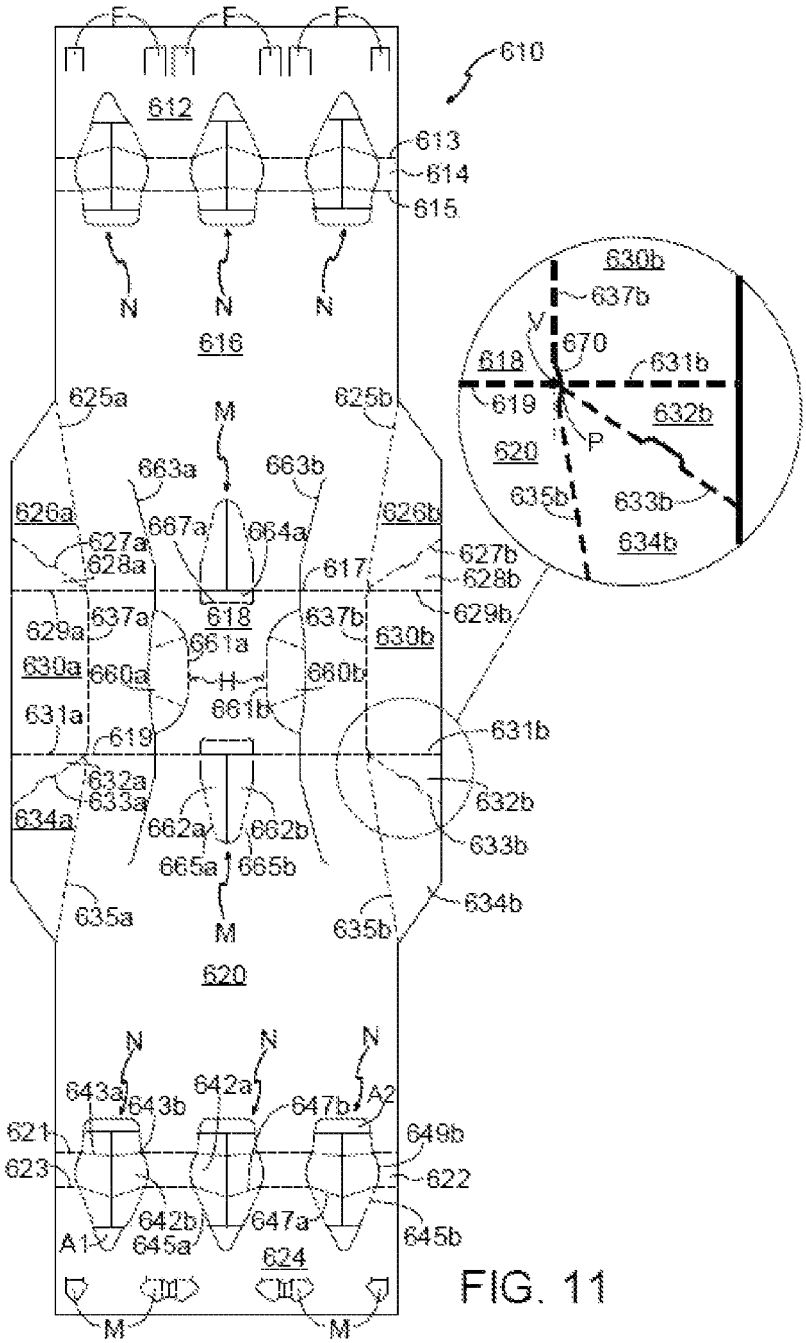
FIG. 11 is a plan view from above of a blank for forming a carton according to a seventh embodiment.
Figure 15A:
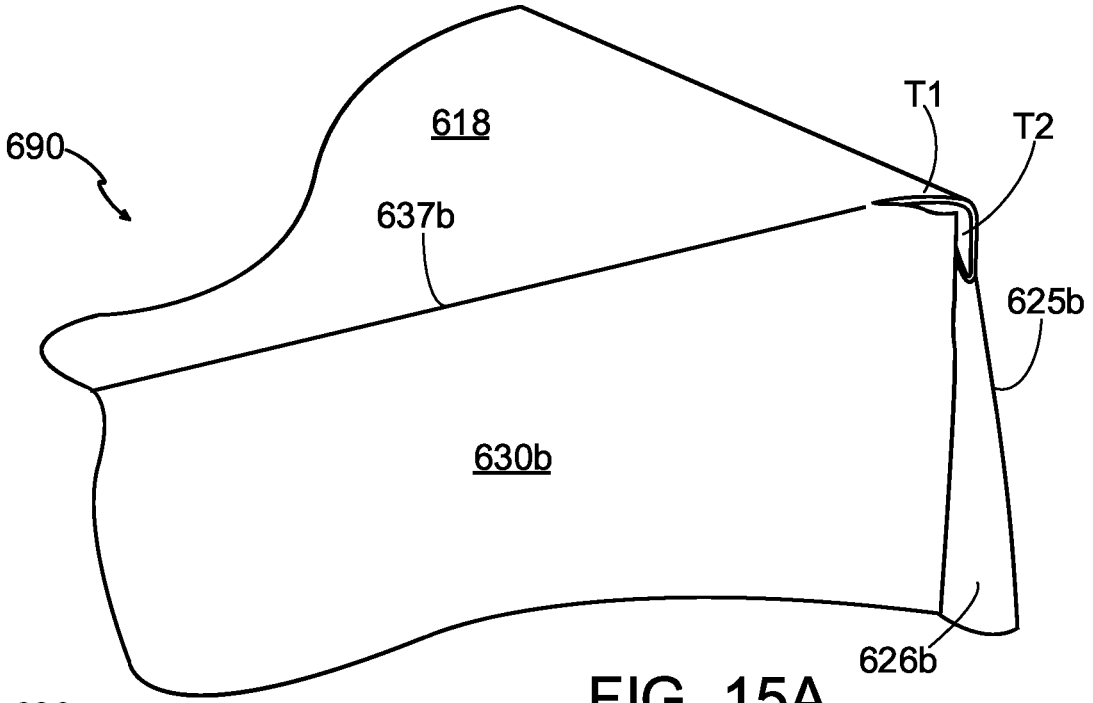
FIGS. 15A and 15B are perspective views from above of portions of a carrier formed from the blank of FIG. 11.
Figure 15B:
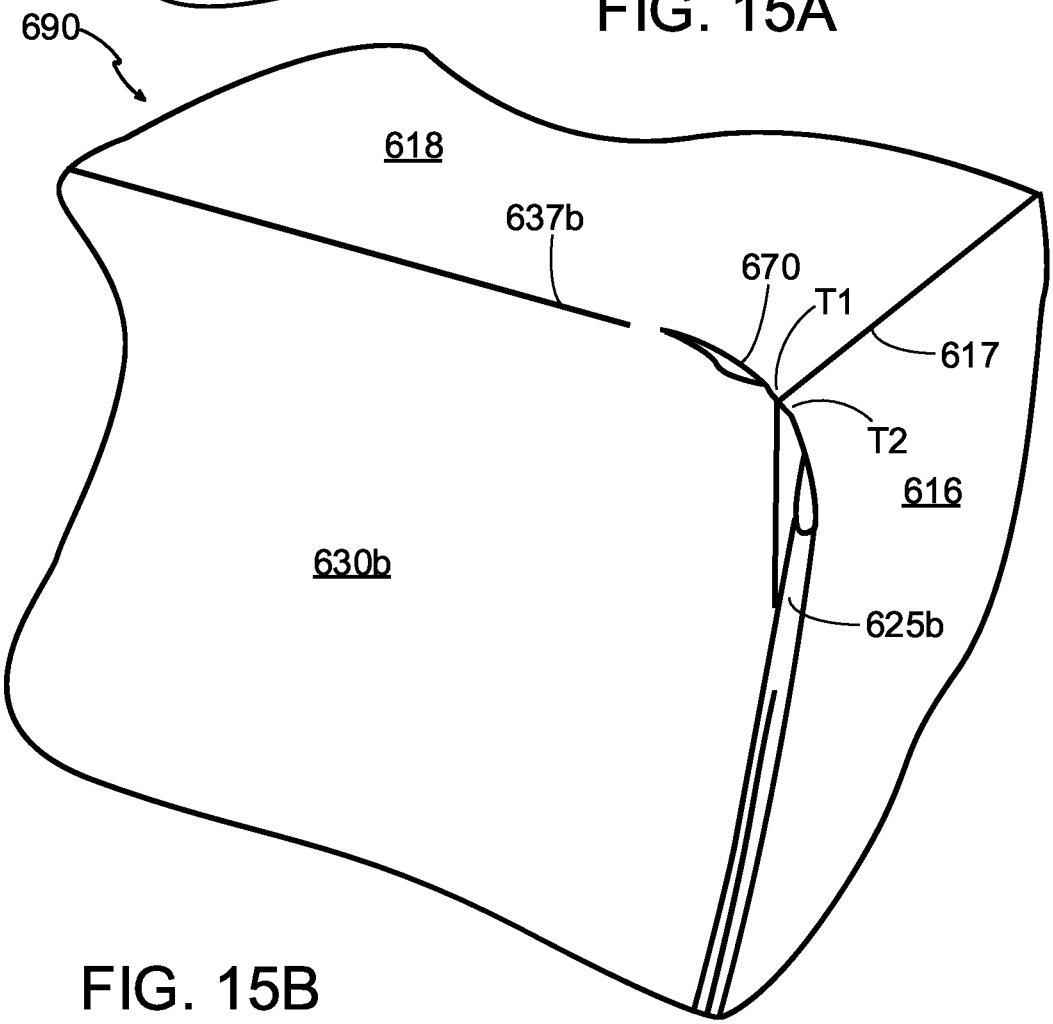

Referring now to FIGS. 11, 15A and 15B there is shown an alternative embodiment of the present disclosure. In the seventh illustrated embodiment, like numerals have, where possible, been used to denote like parts, albeit with the addition of the prefix "600" to indicate that these features belong to the seventh embodiment.

FIG. 11 shows a blank 610 for forming a carrier, the blank 610 comprises a plurality of main panels 612, 614, 616, 618, 620, 622, 624 for forming a tubular structure. The plurality of main panels 612, 614, 616, 618, 620, 622, 624 comprises; a first base panel 612, a first lower corner panel 614, a first side panel 616, a top panel 618, a second side panel 620, a second lower corner panel 622, and a second base panel 624. The plurality of main panels 612, 614, 616, 618, 620, 622, 624 may be arranged in a linear series hinged one to the next by corresponding fold lines 613, 615, 617, 619, 621, 623.

The first and second lower corner panels 614, 622 may be considered to form part of a bottom wall of the carrier 690 along with the first and second base panels 612, 624. Alternatively, the first and second lower corner panels 614, 622 may be considered to form a lower portion of a respective one of the first and second side panels 616, 620. In some embodiments the first and second lower corner panels 614, 622 may be omitted, in such embodiments the fold lines 615 and 621 may be omitted.

The blank 610 may comprise a complementary locking mechanism for securing the second base panel 624 to the first base panel 612. The second base panel 624 may comprise at least one first part M of the complementary locking mechanism. The first base panel 612 may comprise at least one second part F of the complementary locking mechanism.

The blank 610 comprises an optional carrying handle structure H. The handle structure H comprises a pair of foldable tabs 660*a*, 660*b*. The tabs 660*a*, 660*b* are spaced apart from each other. The tabs 660*a*, 660*b* are hingedly connected to the top panel 618 by fold lines 661*a*, 661*b* and are defined in part by a cut line or severance line 663*a*, 663*b*. Each of the severance lines 663*a*, 663*b* may extend into one or both of the first and second upper side panels 616, 620. The A first one of the tabs 660*a* is hingedly connected to the top panel 618 in opposition to a second one of the tabs 660*b*.

The blank 610 comprises at least one end closure structure for at least partially closing an end of a tubular structure defined by the plurality of panels 612, 614, 616, 618, 620, 622, 624. The blank 610 comprises a first end closure structure comprising a plurality of end closure panels 626*a*, 628*a*, 630*a*, 632*a*, 634*a*.

The first end closure structure comprises a first top end closure flap 630*a* hingedly connected to the top panel 618 by a fold line 637*a*.

A first gusset panel 628*a* is hingedly connected to the first top end closure flap 630*a* by a hinged connection in the form of a fold line 629*a*.

A first anchor panel 626*a* is hingedly connected to the first gusset panel 628*a* by a hinged connection in the form of a fold line 627*a*. The first anchor panel 626*a* is hingedly connected to the first side panel 616 by a hinged connection in the form of a fold line 625*a*.

A second gusset panel 632*a* is hingedly connected to the first top end closure flap 630*a* by a hinged connection in the form of a fold line 631*a*.

A second anchor panel 634*a* is hingedly connected to the second gusset panel 632*a* by a hinged connection in the form of a fold line 633*a*. The second anchor panel 634*a* is hingedly connected to the second side panel 620 by a hinged connection in the form of a fold line 635*a*. The blank 610 comprises a second end closure structure comprising a plurality of end closure panels 626*b*, 628*b*, 630*b*, 632*b*, 634*b*.

The second end closure structure comprises a second top end closure flap 630*b* hingedly connected to the top panel 618 by a fold line 637*b*.

A third gusset panel 628*b* is hingedly connected to the second top end closure flap 630*b* by a hinged connection in the form of a fold line 629*b*.

A third anchor panel 626*b* is hingedly connected to the third gusset panel 628*b* by a hinged connection in the form of a fold line 627*b*. The third anchor panel 626*b* is hingedly connected to the first side panel 616 by a hinged connection in the form of a fold line 625*b*.

A fourth gusset panel 632*b* is hingedly connected to the second top end closure flap 630*b* by a hinged connection in the form of a fold line 631*b*.

A fourth anchor panel 634*b* is hingedly connected to the fourth gusset panel 632*b* by a hinged connection in the form of a fold line 633*b*. The fourth anchor panel 634*b* is hingedly connected to the second side panel 620 by a hinged connection in the form of a fold line 635*b*.

The blank 610 comprises four corner folding arrangements at each corner of the top panel 618, the corner folding arrangements are substantially the same and will be described with regard to an enlarged view of one of the corner arrangements shown in FIG. 11.

The corner folding arrangement comprises a severance line 670 in the form of a cut line. The severance line 670 extends across or intersects the fold line 619 between the top panel 618 and the second side panel 620, this fold line is also referred to herein as second fold line 619.

The severance line 670 extends from the fold line 635*b* between the second side panel 620 and the fourth anchoring panel 634*b*, the fold line 635*b* is also referred to herein as fourth fold line 635*b*.

The severance line 670 extends towards the fold line 637*b* between the top panel 618 and the second top end closure flap 630*b*. The severance line 670 may extend to the fold line 637*b* between the top panel 618 and the second top end closure flap 630*b*. The severance line 670 extends beyond or past the fold line 637*b* between the top panel 618 and the second top end closure flap 630*b* so as to extend into the top panel 618. The fold line 637*b* is also referred to herein as first fold line 637*b*.

The severance line 670 extends across or through the fold line 631*b* between the second top end closure panel 630*b* and the fourth gusset panel 632*b*, this fold line is also referred to herein as third fold line 631*b*.

The severance line 670 extends across or through the fold line 633*b* between the fourth anchoring panel 634*b* and the fourth gusset panel 632*b*, this fold line is also referred to herein as fifth fold line 633*b*.

The severance line 670 can be considered to intersect or terminate each of the first, second, third, fourth and fifth fold lines 637*b*, 619, 631*b*, 635*b*, 633*b*.

The severance line 670 in the illustrated embodiment is non-linear and may be curvilinear. In other embodiments the severance line 670 may be defined by two or more linear sections divergently arranged with respect to each other. In still other embodiments the severance line 670 may be linear.

The severance line 670 extends between the first fold line 637*b* and fourth fold line 635*b*.

The severance line 670 bypasses a notional intersection or vertex V between a notional extension of the first fold line 637*b* and the second fold line 619 such that the notional intersection V is located on one side of the severance line 670. The notional intersection V is located on a first side of the severance line 670 and the fourth anchoring panel 634*b* and the fourth gusset panel 632*b* are located on a second, opposing, side of the severance line 670. The notional intersection V may be spaced apart from the fourth anchoring panel 634*b* and the fourth gusset panel 632*b*.

The third fold line 631*b*, or a notional extension thereof, may intersect or pass through the notional vertex V. Notional extensions of the fourth and fifth fold lines 635*b*, 633*b* may intersect or pass through the notional vertex V.

The fifth fold line 633*b* may be interrupted by a "U" shaped cut line to define a tab portion struck from material which would otherwise form the fourth gusset panel 632*b*. The tab portion is integral with the fourth anchoring panel 634*b*.

The severance line 670 intersects with the third fold line 633*b* at a first intersection P. The first intersection P is disposed at a position closer to the fourth gusset panel 632*b* than the notional intersection V of the first fold line 637*b* and second fold line 619.

Figure 12:
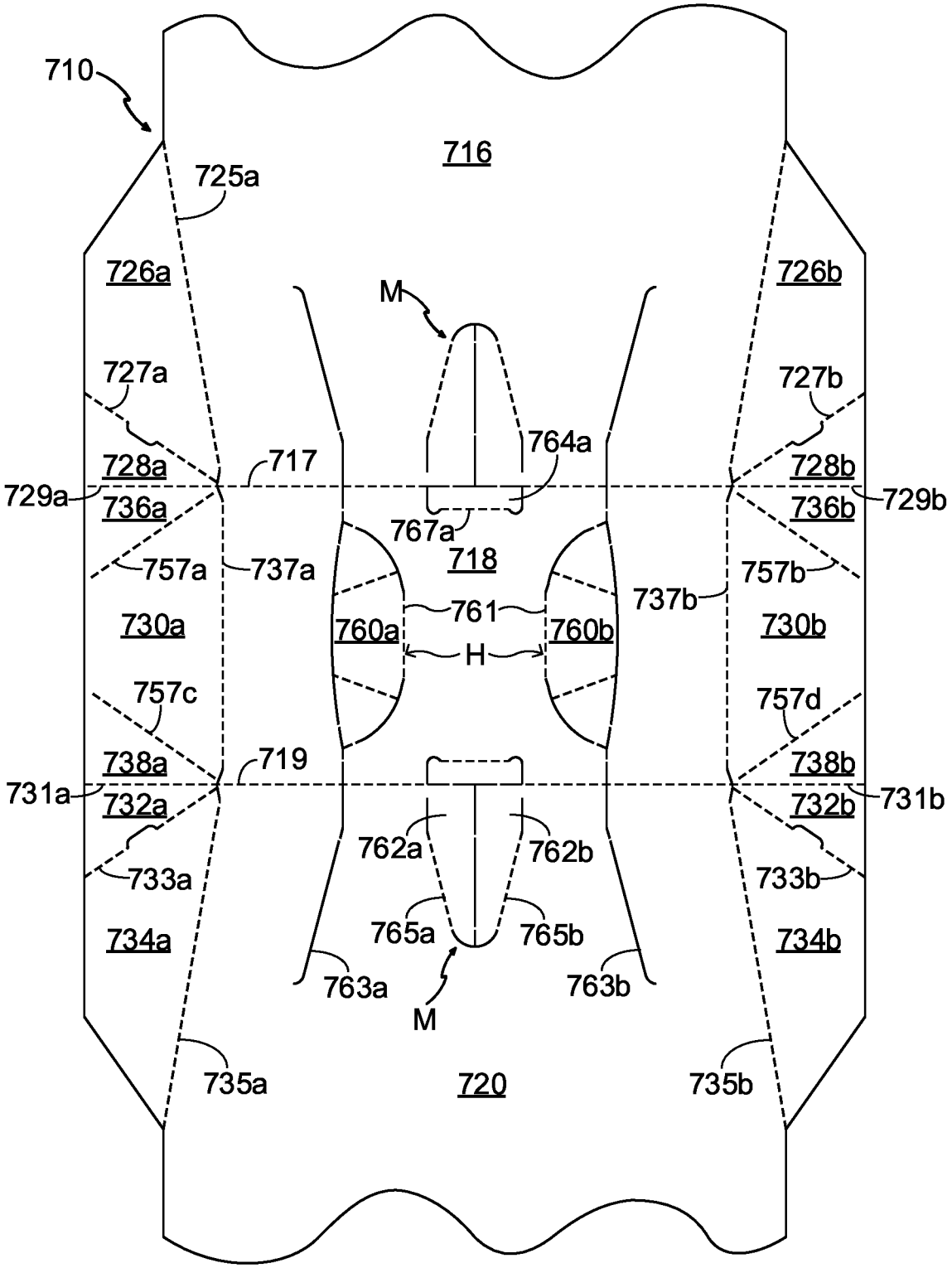
FIG. 12 is a plan view from above of a portion of a blank for forming a carton according to an eighth embodiment.

Referring now to FIG. 12 there is shown an alternative embodiment of the present disclosure. In the eighth illustrated embodiment, like numerals have, where possible, been used to denote like parts, albeit with the addition of the prefix "700" to indicate that these features belong to the eighth embodiment. The eighth embodiment shares many common features with the embodiment of FIGS. 11, 15A and 15B, therefore only the differences from the embodiment illustrated in FIGS. 11, 15A and 15B will be described in any greater detail.

FIG. 12 shows a portion of a blank 710 for forming a carrier, the blank 710 comprises a plurality of main panels 716, 718, 720 for forming a tubular structure. The plurality of main panels 716, 718, 720 includes; a first side panel 716, a top panel 718 and a second side panel 720. The plurality of main panels 716, 718, 720 may be arranged in a linear series hinged one to the next by corresponding fold lines 717, 719.

The blank 710 comprises an optional carrying handle structure H. The handle structure H comprises a pair of foldable tabs 760*a*, 760*b*.

The blank 710 comprises at least one end closure structure for at least partially closing an end of a tubular structure defined by the plurality of panels 716, 718, 720. The blank 710 comprises a first end closure structure comprising a plurality of end closure panels 726*a*, 728*a*, 730*a*, 732*a*, 734*a*, 736*a*, 738*a*. The first end closure structure comprises a first top end closure flap 730*a* hingedly connected to the top panel 718 by a fold line 737*a*.

A first web panel 736*a* is hingedly connected to the first top end closure flap 730*a* by a hinged connection in the form of a fold line 737*a*. A first gusset panel 728*a* is hingedly connected to the first web panel 736*a* by a hinged connection in the form of a fold line 729*a*.

A first anchor panel 726*a* is hingedly connected to the first gusset panel 728*a* by a hinged connection in the form of a fold line 727*a*. The first anchor panel 726*a* is hingedly connected to the first side panel 716 by a hinged connection in the form of a fold line 725*a*.

A second web panel 738*a* is hingedly connected to the first top end closure flap 730*a* by a hinged connection in the form of a fold line 739*a*. A second gusset panel 732*a* is hingedly connected to the second web panel 738*a* by a hinged connection in the form of a fold line 731*a*.

A second anchor panel 734*a* is hingedly connected to the second gusset panel 732*a* by a hinged connection in the form of a fold line 733*a*. The second anchor panel 734*a* is hingedly connected to the second side panel 720 by a hinged connection in the form of a fold line 735*a*.

The blank 710 comprises a second end closure structure comprising a plurality of end closure panels 726*b*, 728*b*, 730*b*, 732*b*, 734*b*, 736*b*, 738*b*. The second end closure structure comprises a second top end closure flap 730*b* hingedly connected to the top panel 718 by a fold line 737*b*.

A third web panel 736*b* is hingedly connected to the second top end closure flap 730*b* by a hinged connection in the form of a fold line 737*b*. A third gusset panel 728*b* is hingedly connected to the third web panel 736*b* by a hinged connection in the form of a fold line 729*b*.

A third anchor panel 726*b* is hingedly connected to the third gusset panel 728*b* by a hinged connection in the form of a fold line 727*b*. The third anchor panel 726*b* is hingedly connected to the first side panel 616 by a hinged connection in the form of a fold line 725*b*.

A fourth web panel 738*b* is hingedly connected to the second top end closure flap 730*b* by a hinged connection in the form of a fold line 739*b*. A fourth gusset panel 732*b* is hingedly connected to the fourth web panel 738*b* by a hinged connection in the form of a fold line 731*b*.

A fourth anchor panel 734*b* is hingedly connected to the fourth gusset panel 732*b* by a hinged connection in the form of a fold line 733*b*. The fourth anchor panel 734*b* is hingedly connected to the second side panel 720 by a hinged connection in the form of a fold line 735*b*.

FIG. 12 illustrate a portion of a blank 710. The blank 710 comprises four corner folding arrangements, substantially similar in arrangement to the corner folding arrangements of the embodiment of FIG. 11. In the embodiment of FIG. 12 the corner folding arrangements each comprise an additional fold line 757*a*, 757*b*, 757*c*, 757*d*. The fold lines 757*a*, 757*b*, 757*c*, 757*d* are provided in respective ones of the first and second top end closure panel 730*a*, 730*b* and extend divergently with respect to third fold lines 729*a*, 729*b*, 731*a*, 731*b*. The fold lines 757*a*, 757*b*, 757*c*, 757*d* may extend towards a notional vertex V defined by a respective one of the second fold lines 717, 719 and one of the first fold line 737*a*, 737*b* (or at least a notional extension of the first fold line 737*a*, 737*b*).

The present disclosure provides a corner folding arrangement comprising a first panel 18; 118; 218; 324; 420; 520; 618; 718; 820, second panel 32*b*; 138*b*; 328*b*; 346*b*; 440*b*; 540*b*; 630*b*; 730*b*; 840*b* and a third panel 20; 120; 220; 322; 422/424; 522/524; 620; 720; 822/824. The first panel 18; 118; 218; 324; 420; 520; 618; 718; 820 comprises a corner defined by an end edge and a side edge. The second panel 32*b*; 138*b*; 328*b*; 346*b*; 440*b*; 540*b*; 630*b*; 730*b*; 840*b* is hingedly connected to the end edge of the first panel along a first fold line 33*b*; 139*b*; 239*b*; 353*b*; 443*b*; 543*b*; 637*b*; 737*b*; 843*b*. The third panel 20; 120; 220; 322; 422/424; 522/524; 620; 720; 822/824 is hingedly connected to the side edge of the first panel along a second fold line 19; 19; 219; 323; 421; 521; 619; 719; 821. A fourth panel 34*b*; 142*b*; 242*b*; 344*b*; 442*b*; 542*b*; 632*b*; 732*b*; 842*b* is hinged to a fifth panel 36*b*; 144*b*; 244*b*; 342*b*; 444*b*; 544*b*; 634*b*; 734*b*; 844*b*. The fourth and fifth panel (also referred to herein as a pair of gusset panels) couple the second panel to the third panel. The fourth panel (also referred herein a gusset panel) is hingedly connected to the second panel 32*b*; 138*b*; 328*b*; 346*b*; 440*b*; 540*b*; 630*b*; 730*b*; 840*b* along a third fold line 35*b*; 143*b*; 243*b*; 351*b*; 445*b*; 545*b*; 631*b*; 731*b*; 845*b*. The fifth panel (also referred to herein as an anchoring panel) is hingedly connected to the third panel 20; 120; 220; 322; 422/424; 522/524; 620; 720; 822/824 along a fourth fold line 39*b*; 149*b*; 249*b*; 347*b*; 449*b*; 549*b*; 633*b*; 733*b*; 849*b*. A severance line 70; 170; 270; 370; 470; 570; 670; 770; 870 extends between the first and fourth fold lines or between the second and third fold lines. In an unfolded blank form the severance line 70; 170; 270; 370; 470; 570; 670; 770; 870 bypasses a notional intersection V of the first and second fold lines such that the notional intersection V is located on one side of the severance line 70; 170; 270; 370; 470; 570; 670; 770; 870 spaced apart from the fourth and fifth panels.

Advantageously, the corner folding arrangement facilitate folding of a corner structure and provides an aesthetic appearance. The corner folding arrangement maintains the panels of the corner folding arrangement in an overlapping arrangement. The arrangement avoids creating a large opening into the interior. The severance line 70; 170; 270; 370; 470; 570; 670; 770; 870 may open slightly however such opening is substantially concealed or disguised by projections T1, T2 of one or more of the panels of the corner folding arrangement.

The first panel 18; 118; 218; 324; 420; 520; 618; 718; 820 and the third panel 20; 120; 220; 322; 422/424; 522/524; 620; 720; 822/824 may define in part a tubular structure, the second panel 32*b*; 138*b*; 328*b*; 346*b*; 440*b*; 540*b*; 630*b*; 730*b*; 840*b* may at least partially close an end of the tubular structure.

The present disclosure provides a carton 90; 190; 290; 390; 490; 690 for packaging articles B. The carton 990; 190; 290; 390; 490; 690 comprises a plurality of panels forming walls of a tubular structure including a top wall 18; 118; 218; 318; 420; 520; 618; 718; 820, a first side wall 16; 114/116; 214/216; 314; 416; 616; 716, abase wall 12/24; 112/124; 212/224; 312/324; 412/428; 612/624, and a second side wall 20; 120; 220; 322; 424; 524; 620; 720; 824, optionally hingedly connected to each other in a linear series. The carton 90; 190; 290; 390; 490; 690 may comprise a carrying handle H defined in at least one of the plurality of panels.

The plurality of panels define an interior of the tubular structure for receiving one or more articles. The plurality of panels includes a first panel 18; 118; 218; 324; 420; 520; 618; 718; 820 having a corner defined by an end edge and a side edge. A second panel 32*b*; 138*b*; 328*b*; 346*b*; 440*b*; 540*b*; 630*b*; 730*b*; 840*b* is hingedly connected to the end edge of the first panel 18; 118; 218; 324; 420; 520; 618; 718; 820 along a first fold line 33*b*; 139*b*; 239*b*; 353*b*; 443*b*; 543*b*; 637*b*; 737*b*; 843*b*. A third panel 20; 120; 220; 322; 422/424; 522/524; 620; 720; 822/824 is hingedly connected to the side edge of the first panel 18; 118; 218; 324; 420; 520; 618; 718; 820 along a second fold line 19; 19; 219; 323; 421; 521; 619; 719; 821. A fourth panel 34*b*; 142*b*; 242*b*; 344*b*; 442*b*; 542*b*; 632*b*; 732*b*; 842*b* is hinged to a fifth panel 36*b*; 144*b*; 244*b*; 342*b*; 444*b*; 544*b*; 634*b*; 734*b*; 844*b*. The fourth and fifth panel couple the second panel to the third panel. The fourth and fifth panels are disposed in the interior of the carton 90; 190; 290; 390; 490; 690. The fourth panel 34*b*; 142*b*; 242*b*; 344*b*; 442*b*; 542*b*; 632*b*; 732*b*; 842*b* is hingedly connected to the second panel 32*b*; 138*b*; 328*b*; 346*b*; 440*b*; 540*b*; 630*b*; 730*b*; 840*b* along a third fold line 35*b*; 143*b*; 243*b*; 351*b*; 445*b*; 545*b*; 631*b*; 731*b*; 845*b*. The fifth panel 36*b*; 144*b*; 244*b*; 342*b*; 444*b*; 544*b*; 634*b*; 734*b*; 844*b* is hingedly connected to the third panel 20; 120; 220; 322; 422/424; 522/524; 620; 720; 822/824 along a fourth fold line 39*b*; 149*b*; 249*b*; 347*b*; 449*b*; 549*b*; 633*b*; 733*b*; 849*b*. A severance line 70; 170; 270; 370; 470; 570; 670; 770; 870 extends between the first and fourth fold lines or between the second and third fold lines. In an unfolded blank form the severance line 70; 170; 270; 370; 470; 570; 670; 770; 870 bypasses a notional intersection V of the first and second fold lines such that the notional intersection V is located on one side of the severance line 70; 170; 270; 370; 470; 570; 670; 770; 870 and is spaced apart from the fourth and fifth panels.

The present disclosure also provides a carton 90; 190; 290; 390; 490; 690 for packaging articles B. The carton 990; 190; 290; 390; 490; 690 comprises a plurality of panels forming walls of a tubular structure having an interior. The carton 90; 190; 290; 390; 490; 690 comprises a first wall 18; 118; 218; 324; 420; 520; 618; 718; 820 having an end edge and a side edge adjacent the end edge. A second wall 32*b*; 138*b*; 328*b*; 346*b*; 440*b*; 540*b*; 630*b*; 730*b*; 840*b* is adjacent to the first wall 18; 118; 218; 324; 420; 520; 618; 718; 820. The second wall 32*b*; 138*b*; 328*b*; 346*b*; 440*b*; 540*b*; 630*b*; 730*b*; 840*b* may be hingedly connected to the end edge of the first wall 18; 118; 218; 324; 420; 520; 618; 718; 820 along a first fold line 33*b*; 139*b*; 239*b*; 353*b*; 443*b*; 543*b*; 637*b*; 737*b*; 843*b*. A third wall 20; 120; 220; 322; 422/424; 522/524; 620; 720; 822/824 is adjacent to the first wall 18; 118; 218; 324; 420; 520; 618; 718; 820 and to the second wall 32*b*; 138*b*; 328*b*; 346*b*; 440*b*; 540*b*; 630*b*; 730*b*; 840*b*. The third wall 20; 120; 220; 322; 422/424; 522/524; 620; 720; 822/824 may be hingedly connected to the side edge of the first panel 18; 118; 218; 324; 420; 520; 618; 718; 820 along a second fold line 19; 19; 219; 323; 421; 521; 619; 719; 82. A severance line 70; 170; 270; 370; 470; 570; 670; 770; 870 extends at least between the first and second fold lines. The severance line 70; 170; 270; 370; 470; 570; 670; 770; 870 is divergently arranged with respect to one of the first or second fold lines so as to define, at least in part, a projection T1 integral with the first wall 18; 118; 218; 324; 420; 520; 618; 718; 820 and extending outwardly from said one of the first or second fold lines.

A pair of gusset panels may be hingedly connected to each other by a fifth fold line. The pair of gusset panels couple the second panel to the third panel. The pair of gusset panels may be disposed in the interior of the carton.

A first gusset panel 34*b*; 142*b*; 242*b*; 344*b*; 442*b*; 542*b*; 632*b*; 732*b*; 842*b* may be hingedly connected to a side edge of the second wall 32*b*; 138*b*; 328*b*; 346*b*; 440*b*; 540*b*; 630*b*; 730*b*; 840*b* along a third fold line 35*b*; 143*b*; 243*b*; 351*b*; 445*b*; 545*b*; 631*b*; 731*b*; 845*b*. A portion of the severance line 70; 170; 270; 370; 470; 570; 670; 770; 870 extends at least between the first and third fold lines said portion of the severance line 70; 170; 270; 370; 470; 570; 670; 770; 870 is divergently arranged with respect to the third fold line 35*b*; 143*b*; 243*b*; 351*b*; 445*b*; 545*b*; 631*b*; 731*b*; 845*b* so as to define, at least in part, a projection T2. The projection T2 is integral with the second wall 32*b*; 138*b*; 328*b*; 346*b*; 440*b*; 540*b*; 630*b*; 730*b*; 840*b* and extends outwardly from the third fold line 35*b*; 143*b*; 243*b*; 351*b*; 445*b*; 545*b*; 631*b*; 731*b*; 845*b*.

A second gusset panel 36*b*; 144*b*; 244*b*; 342*b*; 444*b*; 544*b*; 634*b*; 734*b*; 844*b* may be hingedly connected to an end edge of the third wall 20; 120; 220; 322; 422/424; 522/524; 620; 720; 822/824 along a fourth fold line 20; 120; 220; 322; 422/424; 522/524; 620; 720; 822/824. A portion of the severance line 70; 170; 270; 370; 470; 570; 670; 770; 870 extends at least between the fourth and second fold lines said portion of the severance line 70; 170; 270; 370; 470; 570; 670; 770; 870 is divergently arranged with respect to the fourth fold line 39*b*; 149*b*; 249*b*; 347*b*; 449*b*; 549*b*; 633*b*; 733*b*; 849*b* so as to define, at least in part a projection T2. The projection T2 is integral with the third wall 20; 120; 220; 322; 422/424; 522/524; 620; 720; 822/824 and extends outwardly from the fourth fold line 20; 120; 220; 322; 422/424; 522/524; 620; 720; 822/824.

The present disclosure also provides a blank 10; 110; 210; 310; 410; 510; 610; 710; 810 for forming a carton 90; 190; 290; 390; 490; 690. The blank 10; 110; 210; 310; 410; 510; 610; 710; 810 comprises plurality of panels forming walls of a tubular structure defining an interior. The plurality of panels includes a first panel 18; 118; 218; 324; 420; 520; 618; 718; 820 having a corner defined by an end edge and a side edge. A second panel 32*b*; 138*b*; 328*b*; 346*b*; 440*b*; 540*b*; 630*b*; 730*b*; 840*b* is hingedly connected to the end edge of the first panel 18; 118; 218; 324; 420; 520; 618; 718; 820 along a first fold line 33*b*; 139*b*; 239*b*; 353*b*; 443*b*; 543*b*; 637*b*; 737*b*; 843*b*. A third panel 20; 120; 220; 322; 422/424; 522/524; 620; 720; 822/824 is hingedly connected to the side edge of the first panel 18; 118; 218; 324; 420; 520; 618; 718; 820 along a second fold line 19; 19; 219; 323; 421; 521; 619; 719; 821. A fourth panel 34*b*; 142*b*; 242*b*; 344*b*; 442*b*; 542*b*; 632*b*; 732*b*; 842*b* is hinged to a fifth panel 36*b*; 144*b*; 244*b*; 342*b*; 444*b*; 544*b*; 634*b*; 734*b*; 844*b*. The fourth and fifth panel couple the second panel to the third panel. The fourth and fifth panels are disposed in the interior of the carton 90; 190; 290; 390; 490; 690. The fourth panel 34*b*; 142*b*; 242*b*; 344*b*; 442*b*; 542*b*; 632*b*; 732*b*; 842*b* is hingedly connected to the second panel 32*b*; 138*b*; 328*b*; 346*b*; 440*b*; 540*b*; 630*b*; 730*b*; 840*b* along a third fold line 35*b*; 143*b*; 243*b*; 351*b*; 445*b*; 545*b*; 631*b*; 731*b*; 845*b*. The fifth panel 36*b*; 144*b*; 244*b*; 342*b*; 444*b*; 544*b*; 634*b*; 734*b*; 844*b* is hingedly connected to the third panel 20; 120; 220; 322; 422/424; 522/524; 620; 720; 822/824 along a fourth fold line 39*b*; 149*b*; 249*b*; 347*b*; 449*b*; 549*b*; 633*b*; 733*b*; 849*b*. A severance line 70; 170; 270; 370; 470; 570; 670; 770; 870 extends between the first and fourth fold lines or between the second and third fold lines. In an unfolded blank form the severance line 70; 170; 270; 370; 470; 570; 670; 770; 870 bypasses a notional intersection V of the first and second fold lines such that the notional intersection V is located on one side of the severance line 70; 170; 270; 370; 470; 570; 670; 770; 870 and is spaced apart from the fourth and fifth panels.

The present disclosure also provides a blank 10; 110; 210; 310; 410; 510; 610; 710; 810 for forming a carton 90; 190; 290; 390; 490; 690. The blank 10; 110; 210; 310; 410; 510; 610; 710; 810 comprises a first panel 18; 118; 218; 324; 420; 520; 618; 718; 820 having a corner defined by an end edge and a side edge. An end flap 32*b*; 138*b*; 328*b*; 346*b*; 440*b*; 540*b*; 630*b*; 730*b*; 840*b* is hingedly connected to the end edge of the first panel 18; 118; 218; 324; 420; 520; 618; 718; 820 along a first fold line 33*b*; 139*b*; 239*b*; 353*b*; 443*b*; 543*b*; 637*b*; 737*b*; 843*b* for at least partially closing an end of the carton 90; 190; 290; 390; 490; 690. A side panel 20; 120; 220; 322; 422/424; 522/524; 620; 720; 822/824 is hingedly connected to the side edge of the first panel 18; 118; 218; 324; 420; 520; 618; 718; 820 along a second fold line 19; 19; 219; 323; 421; 521; 619; 719; 821. A pair of first and second hinged gusset panels extend between the end flap 32*b*; 138*b*; 328*b*; 346*b*; 440*b*; 540*b*; 630*b*; 730*b*; 840*b* and the side panel 20; 120; 220; 322; 422/424; 522/524; 620; 720; 822/824 for placement under one of the end flap 32*b*; 138*b*; 328*b*; 346*b*; 440*b*; 540*b*; 630*b*; 730*b*; 840*b* and the side panel 20; 120; 220; 322; 422/424; 522/524; 620; 720; 822/824 when the carton 90; 190; 290; 390; 490; 690 is erected. The first gusset panel 34*b*; 142*b*; 242*b*; 344*b*; 442*b*; 542*b*; 632*b*; 732*b*; 842*b* is hingedly connected to the end flap 32*b*; 138*b*; 328*b*; 346*b*; 440*b*; 540*b*; 630*b*; 730*b*; 840*b* along a third fold line 35*b*; 143*b*; 243*b*; 351*b*; 445*b*; 545*b*; 631*b*; 731*b*; 845*b*. The second gusset panel is hingedly connected to the side panel 20; 120; 220; 322; 422/424; 522/524; 620; 720; 822/824 along a fourth fold line 39*b*; 149*b*; 249*b*; 347*b*; 449*b*; 549*b*; 633*b*; 733*b*; 849*b*. A severance line 70; 170; 270; 370; 470; 570; 670; 770; 870 extends between the first and fourth fold lines or between the second and third fold lines. The severance line 70; 170; 270; 370; 470; 570; 670; 770; 870 bypasses a notional intersection V of the first and second fold lines such that the notional intersection V is located on one side of the severance line 70; 170; 270; 370; 470; 570; 670; 770; 870 spaced apart from the first and second gusset panels.

The present disclosure also provides a blank 10; 110; 210; 310; 410; 510; 610; 710; 810 for forming a carton 90; 190; 290; 390; 490; 690. The blank 10; 110; 210; 310; 410; 510; 610; 710; 810 comprises a first panel 18; 118; 218; 324; 420; 520; 618; 718; 820 having a corner defined by an end edge and a side edge. An end flap 32*b*; 138*b*; 328*b*; 346*b*; 440*b*; 540*b*; 630*b*; 730*b*; 840*b* is hingedly connected to the end edge of the first panel 18; 118; 218; 324; 420; 520; 618; 718; 820 along a first fold line 33*b*; 139*b*; 239*b*; 353*b*; 443*b*; 543*b*; 637*b*; 737*b*; 843*b* for at least partially closing an end of the carton 90; 190; 290; 390; 490; 690. A side panel 20; 120; 220; 322; 422/424; 522/524; 620; 720; 822/824 is hingedly connected to the side edge of the first panel 18; 118; 218; 324; 420; 520; 618; 718; 820 along a second fold line 19; 19; 219; 323; 421; 521; 619; 719; 821. A pair of first and second hinged gusset panels extend between the end flap 32*b*; 138*b*; 328*b*; 346*b*; 440*b*; 540*b*; 630*b*; 730*b*; 840*b* and the side panel 20; 120; 220; 322; 422/424; 522/524; 620; 720; 822/824 for placement under one of the end flap 32*b*; 138*b*; 328*b*; 346*b*; 440*b*; 540*b*; 630*b*; 730*b*; 840*b* and the side panel 20; 120; 220; 322; 422/424; 522/524; 620; 720; 822/824 when the carton 90; 190; 290; 390; 490; 690 is erected.

The first gusset panel 34*b*; 142*b*; 242*b*; 344*b*; 442*b*; 542*b*; 632*b*; 732*b*; 842*b* is hingedly connected to the end flap 32*b*; 138*b*; 328*b*; 346*b*; 440*b*; 540*b*; 630*b*; 730*b*; 840*b* along a third fold line 35*b*; 143*b*; 243*b*; 351*b*; 445*b*; 545*b*; 631*b*; 731*b*; 845*b*. The second gusset panel is hingedly connected to the side panel 20; 120; 220; 322; 422/424; 522/524; 620; 720; 822/824 along a fourth fold line 39*b*; 149*b*; 249*b*; 347*b*; 449*b*; 549*b*; 633*b*; 733*b*; 849*b*. A severance line 70; 170; 270; 370; 470; 570; 670; 770; 870 extends between the first and fourth fold lines or between the second and third fold lines. The severance line intersects 70; 170; 270; 370; 470; 570; 670; 770; 870 with at least the third or fourth fold line at a first intersection P, P2 such that the first intersection P, P2 is disposed at a position closer to the first gusset panel 34*b*; 142*b*; 242*b*; 344*b*; 442*b*; 542*b*; 632*b*; 732*b*; 842*b* than a notional intersection V of the first and second fold lines.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/ curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A corner folding arrangement for a carton for packaging one or more articles, the corner folding arrangement comprising:

a first panel having a corner defined by an end edge and a side edge;

a second panel hingedly connected to the end edge of the first panel along a first fold line;

a third panel hingedly connected to the side edge of the first panel along a second fold line;

a fourth panel; and a fifth panel hinged to the fourth panel, the fourth and fifth panel coupling the second panel to the third panel;

wherein the fourth panel is hingedly connected to the second panel along a third fold line and the fifth panel is hingedly connected to the third panel along a fourth fold line, and wherein a severance line extends between the first and fourth fold lines or between the second and third fold lines, and, in an unfolded blank form, the severance line bypasses a notional intersection of the first and second fold lines such that the notional intersection is located on one side of the severance line spaced apart from the fourth and fifth panels.

2. The corner folding arrangement of claim 1, wherein the carton for packaging one or more articles comprises a plurality of panels forming walls of a tubular structure having an interior, and wherein the fourth and fifth panels are disposed in the interior of the carton.

3. A carton for packaging one or more articles comprising a plurality of panels forming walls of a tubular structure having an interior, the carton comprising:

a first wall having an end edge and a side edge adjacent the end edge;

a second wall hingedly connected to the end edge of the first wall along a first fold line;

a third wall hingedly connected to the side edge of the first wall along a second fold line;

wherein a severance line extends at least between the first and second fold lines, the severance line being divergently arranged with respect to one of the first or second fold lines so as to define, at least in part, a projection integral with the first wall and extending outwardly from said one of the first or second fold lines.

4. A carton according to claim 3 wherein the carton comprises a pair of gusset panels hingedly connected to each other by a fifth fold line, the pair of gusset panels coupling the second panel to the third panel, the pair of gusset panels being disposed in the interior of the carton.

5. A carton according to claim 3 wherein the carton comprises a first gusset panel hingedly connected to a side edge of the second wall along a third fold line, a portion of the severance line extends at least between the first and third fold lines said portion of the severance line being divergently arranged with respect to the third fold line so as to define, at least in part, a projection integral with the second wall and extending outwardly from the third fold line.

6. A carton according to claim 3 wherein the carton comprises a second gusset panel hingedly connected to an end edge of the third wall along a fourth fold line, a portion of the severance line extends at least between the fourth and second fold lines said portion of the severance line being divergently arranged with respect to the fourth fold line so as to define, at least in part, a projection integral with the third wall and extending outwardly from the fourth fold line.

7. A blank for forming a carton, the blank comprising a plurality of panels forming walls of a tubular structure defining an interior, the plurality of panels including:

a first panel having a corner defined by an end edge and a side edge;

a second panel hingedly connected to the end edge of the first panel along a first fold line;

a third panel hingedly connected to the side edge of the first panel along a second fold line; and a fourth panel; and a fifth panel hinged to the fourth panel, the fourth and fifth panel coupling the second panel to the third panel, the fourth and fifth panels disposed in the interior when the carton is erected;

wherein the fourth panel is hingedly connected to the second panel along a third fold line and the fifth panel is hingedly connected to the third panel along a fourth fold line, and wherein a severance line extends between the first and fourth fold lines or between the second and third fold lines, the severance line bypasses a notional intersection of the first and second fold lines such that the notional intersection is located on one side of the severance line spaced apart from the fourth and fifth panels.

8. A blank according to claim 7, wherein:

the second panel comprises an end flap hingedly connected to the end edge of the first panel along the first fold line for at least partially closing an end of the carton;

the third panel comprises a side panel hingedly connected to the side edge of the first panel along the second fold line; and the fourth panel comprises a first gusset panel and the fifth panel comprises a second gusset panel hinged to the first gusset panel, the first and second gusset panels extending between the end flap and the side panel for placement under one of the end flap and the side panel when the carton is erected;

wherein the first gusset panel is hingedly connected to the end flap along the third fold line and the second gusset panel is hingedly connected to the side panel along the fourth fold line, and wherein the severance line bypasses the notional intersection of the first and second fold lines such that the notional intersection is located on one side of the severance line spaced apart from the first and second gusset panels.

9. A blank according to claim 8 wherein at least one of the end flap and the first panel comprises one or more additional fold lines.

10. A blank according to claim 8 wherein the severance line extends into at least one of: the first panel, the side panel, and the end flap.

11. A blank according to claim 8 wherein the severance line is convex when viewed from the first gusset panel.

12. A blank according to claim 8 wherein the severance line is concave when viewed from the first gusset panel.

13. A blank according to claim 8 wherein the second gusset panel forms an anchoring panel.

14. A blank according to claim 7, wherein:

the second panel comprises an end flap hingedly connected to the end edge of the first panel along the first fold line for at least partially closing an end of the carton;

the third panel comprises a side panel hingedly connected to the side edge of the first panel along the second fold line; and the fourth panel comprises a first gusset panel and the fifth panel comprises a second gusset panel hinged to the first gusset panel, the first and second gusset panels extending between the end flap and the side panel for placement under one of the end flap and the side panel when the carton is erected, wherein the first gusset panel is hingedly connected to the end flap along the third fold line and the second gusset panel is hingedly connected to the side panel along the fourth fold line, and wherein the severance line intersects with at least the third or fourth fold line at a first intersection such that the first intersection is disposed at a position closer to the first gusset panel than the notional intersection of the first and second fold lines.

15. A blank according to claim 7 wherein the severance line is linear.

16. A blank according to claim 7 wherein the severance line is non-linear.

17. A blank according to claim 16 wherein the severance line is curvilinear or arcuate.

18. A blank according to claim 16 wherein the severance line comprises at least two sections arranged divergently with respect to each other.

19. A blank according to claim 16 wherein the severance line comprises at least two contiguous sections arranged divergently with respect to each other.

* * * * *